US009556664B2

(12) United States Patent
Hudepohl et al.

(10) Patent No.: US 9,556,664 B2
(45) Date of Patent: Jan. 31, 2017

(54) MOTORIZED TILTING WINDOW OPERATOR AND WINDOW

(71) Applicant: JMAC, Inc.

(72) Inventors: Gregory Ronald Hudepohl, Centerville, OH (US); Matthew Michael Barrett, Beavercreek, OH (US); Paul David Bader, Springfield, OH (US); Craig Randall Shilling, Dublin, OH (US)

(73) Assignee: JMAC, INC, Columbus, OH (US)

( * ) Notice: Subject to any disclaimer, the term of this patent is extended or adjusted under 35 U.S.C. 154(b) by 0 days.

(21) Appl. No.: 14/554,854

(22) Filed: Nov. 26, 2014

(65) Prior Publication Data

US 2016/0069119 A1 Mar. 10, 2016

Related U.S. Application Data

(60) Provisional application No. 62/045,998, filed on Sep. 4, 2014.

(51) Int. Cl.

| | |
|---|---|
| ***E05F 15/603*** | (2015.01) |
| ***E05F 15/71*** | (2015.01) |
| ***E05F 1/00*** | (2006.01) |
| ***E05F 11/34*** | (2006.01) |
| ***E05F 15/70*** | (2015.01) |
| ***E05F 11/50*** | (2006.01) |
| ***E05F 15/63*** | (2015.01) |

(52) U.S. Cl.

CPC ..... *E05F 15/71* (2015.01); *E05F 1/002* (2013.01); *E05F 11/34* (2013.01); *E05F 11/50* (2013.01); *E05F 15/603* (2015.01); *E05F 15/63* (2015.01); *E05F 15/70* (2015.01); *E05F 2015/631* (2015.01); *E05F 2700/00* (2013.01); *E05Y 2900/512* (2013.01); *E05Y 2900/55* (2013.01)

(58) Field of Classification Search

CPC ..... E05F 15/603; E05F 15/63; E05F 15/611; E05F 11/34

USPC ..... 49/139, 140, 324, 340

See application file for complete search history.

(56) References Cited

U.S. PATENT DOCUMENTS

| | | | | |
|---|---|---|---|---|
| 3,893,260 | A * | 7/1975 | Cadiou | B60J 5/06 49/140 |
| 4,544,865 | A | 10/1985 | Sharp | |
| 4,544,866 | A | 10/1985 | Clemmons et al. | |
| 4,553,656 | A * | 11/1985 | Lense | E05F 11/24 192/142 R |
| 4,640,314 | A * | 2/1987 | Mock | H02G 3/0418 138/157 |
| 5,006,766 | A | 4/1991 | Yuhas et al. | |
| 5,313,737 | A | 5/1994 | Midas | |
| 5,449,987 | A | 9/1995 | McMillan | |

(Continued)

FOREIGN PATENT DOCUMENTS

| | | |
|---|---|---|
| EP | 1 870 553 | * 12/2007 |
| WO | WO 2013/160087 | * 10/2013 |
| WO | WO 2015/114526 | * 8/2015 |

*Primary Examiner* — Gregory Strimbu

(74) *Attorney, Agent, or Firm* — Vorys, Sater, Seymour and Pease LLP; William L. Klima

(57) ABSTRACT

A motorized tilting window operator and a tilting window. The motorized tilting window operator including one or more motorized drive units configured to connect with and drive one or more manual tilting window operators of the tilting window. The motorized tilting window operator including a cover.

27 Claims, 37 Drawing Sheets

(56) References Cited

U.S. PATENT DOCUMENTS

| | | | | |
|---|---|---|---|---|
| 5,592,778 | A * | 1/1997 | McGuire | E06B 11/08 49/141 |
| 5,813,171 | A | 9/1998 | Piltingsrud | |
| 6,195,940 | B1 * | 3/2001 | Moy | E05F 15/63 49/324 |
| 6,915,608 | B2 * | 7/2005 | Labarre | E05F 15/63 49/140 |
| 6,972,367 | B2 * | 12/2005 | Federspiel | H02G 3/0418 174/481 |
| 2002/0066162 | A1 * | 6/2002 | Klompenburg | E05F 11/16 16/429 |
| 2003/0062865 | A1 * | 4/2003 | Mullet | E05F 15/668 318/445 |
| 2007/0027184 | A1 | 2/2007 | Malecha et al. | |
| 2007/0271848 | A1 * | 11/2007 | Wolf | E05F 15/70 49/340 |
| 2012/0012260 | A1 * | 1/2012 | Elinson | E06B 9/42 160/240 |
| 2012/0227326 | A1 * | 9/2012 | Drux | E05F 3/227 49/358 |
| 2015/0114176 | A1 * | 4/2015 | Bisang | E05F 15/614 74/665 A |

* cited by examiner 220
95
98
96
42
46
40
95
96
98

220
46
90
56
68
68
42
96
94

220
46
42
44
108
100
38
36
10B
40
95
98
96

MOTORIZED TILTING WINDOW OPERATOR AND WINDOW

RELATED APPLICATION(S)

This is a non-provisional application of provisional application No. 62/045,998 filed on Sep. 4, 2014. This non-provisional application claims priority to this provisional application under 35 U.S.C. §119(e).

FIELD

The presently described subject matter relates to a motorized tilting window operator and a motorized tilting window.

BACKGROUND

Currently, there exist manual tilting windows installed in various equipment or structures such as recreational vehicles (RVs), trailers, horse trailers, boats, automobiles, trucks, semi trucks, vans, buildings, etc.

These manual tilting windows typically include a manual operator for tilting the window open or closed. For example, the manual operator comprises a hand crank which opens the window when turned one direction (e.g. clockwise) and closed the window when turned in the opposite direction (e.g. counter clockwise).

SUMMARY

The presently described subject matter is directed to an improved motorized tilting window operator.

The presently described subject matter is further directed to an add on motorized tilting window operator.

The presently described subject matter is also directed to a motorized tilting window operator comprising or consisting of one or more motorized drive units; and a cover connected to the one or more motorized drive units.

The presently described subject matter is directed to a motorized tilting window operator comprising or consisting of one or more motorized drive units; and a channel-shaped cover connected to the one or more motorized drive units.

The presently described subject matter is directed to a motorized tilting window operator comprising or consisting of one or more motorized drive units, and a cover configured to connect to the one or more motorized drive units and cover at least a portion of a frame of a window.

The presently described subject matter is further directed to a motorized tilting window operator comprising or consisting of a motorized drive unit; and a cover configured to connect to the one or more motorized drive units and cover an entire section of a window frame.

The presently described subject matter is directed to a motorized tilting window operator comprising or consisting of one or more motorized drive units; and a cover configured to connect to the one or more motorized drive units and cover an entire a lower horizontal section of a window frame.

The presently described subject matter is also directed to a motorized tilting window operator comprising or consisting of one or more motorized drive units; and a cover configured to connect to the one or more motorized drive units and cover a horizontal section of a window frame, the cover having a length equal to a width of the window frame.

The presently described subject matter is further directed to a motorized tilting window operator comprising or consisting of one or more motorized drive units configured to connect to a window frame; and a cover configured to connect to the one or more motorized drive units and cover at least a portion of a window frame.

The presently described subject matter is further directed to a motorized tilting window operator comprising or consisting of one or more drive units configured to connect to a window frame; and a cover connected to the one or more drive units and cover a section of the window frame.

The presently described subject matter is directed to a motorized tilting window operator comprising or consisting of one or more motorized drive units; and a cover configured to connect to the one or more motorized drive units and cover a lower horizontal section of a window frame.

The presently described subject matter is directed to a motorized tilting window operator comprising or consisting of one or more motorized drive units each configured to connect to one or more manual tilting window operators; and a cover connected to the one or more motorized drive units and covering the one or more motorized drive units.

The presently described subject matter is also directed to a motorized tilting window operator comprising or consisting of one or more motorized drive units each configured to connect to one or more manual tilting window operators; and a cover connected to the one or more motorized drive units and covering the one or more drive units and at least a portion of a window frame.

The presently described subject matter is directed to a motorized tilting window operator comprising or consisting of one or more motorized drive units each configured to connect to one or more manual tilting window operators; and a cover connected to the one or more drive units and covering the one or more drive units and a section of a window frame.

The presently described subject matter is also directed to a motorized tilting window operator comprising or consisting of one or more motorized drive units each configured to connect to one or more manual tilting window operators, the one or more motorized drive units each comprising a drive unit housing; and a cover connected to and covering the one or more motorized drive unit housings of the one or more motorized drive units.

The presently described subject matter is further directed to a motorized tilting window operator comprising or consisting of one or more motorized drive units each configured to connect to one or more manual tilting window operators, the one or more motorized drive units comprising a drive unit housing; and a cover connected to and covering the one or more motorized drive unit housings of the one or more motorized drive units and a portion of a window frame.

The presently described subject matter is directed to a motorized tilting window operator comprising or consisting of one or more motorized drive units, each motorized drive unit comprising an electric motor and a drive unit, each drive unit comprising a drive unit housing, a drive shaft connected to the electric motor, a worm provided on the drive shaft, and a worm gear cooperating with the worm and configured to connect to a manual drive operator; and a cover connected to the one or more motorized drive units.

The presently described subject matter is directed to a motorized tilting window operator comprising or consisting of one or more motorized drive units, each motorized drive unit comprising an electric motor and a drive unit, each drive unit comprising a drive unit housing, a drive shaft connected to the electric motor and disposed within a close fitting recess provided in the drive unit housing, a worm provided on the drive shaft, and a worm gear cooperating with the worm and configured to connect to a manual drive operator, the worm gear disposed within a close fitting through hole provided in the drive unit housing, the through hole being orient perpendicular relative to the recess in which the drive shaft is disposed; and a cover connected to the one or more motorized drive units.

The presently described subject matter is directed to a motorized tilting window operator comprising or consisting of one or more motorized drive units, each motorized drive unit comprising an electric motor and a drive unit, each drive unit comprising a drive unit housing comprising a top drive unit housing portion and a bottom drive unit housing portion, a drive shaft connected to the electric motor and disposed within a close fitting recess provided in the lower drive unit housing portion, a worm provided on the drive shaft, and a worm gear cooperating with the worm and configured to connect to a manual drive operator, the worm gear disposed within a close fitting through hole provided in the bottom drive unit housing portion, the through hole being orient perpendicular relative to the recess in which the drive shaft is disposed; and a cover connected to the one or more motorized drive units.

The presently described subject matter is further directed to a motorized tilting window, comprising a window frame; one or more tilting window sashes; one or more motorized tilting window operators each connected to the window frame; one or more manual tilting window operators connected to each respective one or more motorized tilting window operators; and a cover connected to the one or more motorized tilting window operators.

The presently described subject matter is further directed to a motorized tilting window, comprising a window frame; one or more tilting window sashes; one or more motorized tilting window operators each comprising a motorized drive unit connected to the window frame; one or more manual tilting window operators connected to each respective one or more motorized tilting window operators; and a cover connected to the one or more motorized tilting window operators.

The presently described subject matter is also directed to a motorized tilting window, comprising a window frame; one or more tilting window sashes; one or more motorized tilting window operators each comprising a motorized drive unit connected to the window frame; one or more manual tilting window operators connected to each respective one or more motorized tilting window operators; and a cover connected to the one or more motorized tilting window operators.

The presently described subject matter is a directed to a motorized tilting window, comprising a window frame; one or more tilting window sashes; one or more motorized tilting window operators each connected to the window frame; one or more manual tilting window operators connected to each respective one or more motorized tilting window operators; a cover connected to the one or more motorized tilting window operators, the cover being the width of the window and covering the lower horizontal window frame; and a window shade associated with the window and cooperating with the cover when the window shade is placed in a lowered position.

The presently described motorized tilting window operator can be an add on product for an existing tilting window fitted with one or more manual tilting window operators, or can be a combined motorized tilting window operator and manual tilting window operator for application to a tilting window. The motorized tilting window can be a tilting window fitted with the motorized tilting window operator and a manual titling window operator.

The presently described motorized tilting window operator can comprise one or more motorized drive units, and a cover connected to the one or more motorized drive units. The cover can be removably attached to the motorized drive units (e.g. snap fit connection). The cover can cover the one or more motorized drive units and can cover at least a portion of the window frame (e.g. the length of the cover can be the width of the window, and can cover, for example, the lower horizontal window frame of the window). The cover can cooperate with a window shade applied to the window so that when the window shade is placed in its lowered position (i.e. fully lowered and extended), a lower portion of the window shade contacts the cover (e.g. upper surface of cover). In this manner, light from outside the window application is prevented from passing through the window, since the window shade and cover block off the passage of light through the window into an interior of the window application.

The cover can be made of plastic (e.g. ABS) or metal (e.g. aluminum). The cover can be made by extruding plastic or metal material, or can be made by stamping, molding, or other forming methods. The cover can be a channel-shaped cover having a particular cross-section profile. For example, the channel-shaped cover can be shaped to match or conform with an outer surface of the one or more motorized drive units (e.g. transverse cross-sectional shape of the one or more motorized drive units nests within the transverse cross-sectional shape of the channel-shaped cover).

The one or more motorized drive units can be configured to connect to the window frame and/or manual tilting window operator. For example, the one or more motorized drive units can be fastened at one or more positions onto the window frame, and can connect to drive shafts of the one or more manual tilting window operators. For example, the outputs of the one or more motorized drive units couple (e.g. removably couple) to the inputs of the one or more manual tilting window operators. For example, a worm gear (i.e. output) of the one or more motorized drive units can be configured (e.g. square-shaped receiver) to accommodate an end of the drive shaft (i.e. input) of the one or more manual tilting window operators.

The one or more motorized drive units can each comprise an electric motor connected to a drive unit housing containing a drive shaft. The drive shaft can be supported on opposite ends by bearings disposed within the drive unit housing. The drive shaft can be fitted with a worm cooperating with the worm gear disposed within the drive unit housing. The drive unit housing can be two or more separate drive unit housings to allow assembling the drive arrangement in one drive unit housing portion, and then assembled together to complete the drive unit. The drive unit housing can be made of nylon material (e.g. 35% fiberglass filled nylon).

DETAILED DESCRIPTION

Figure 1:
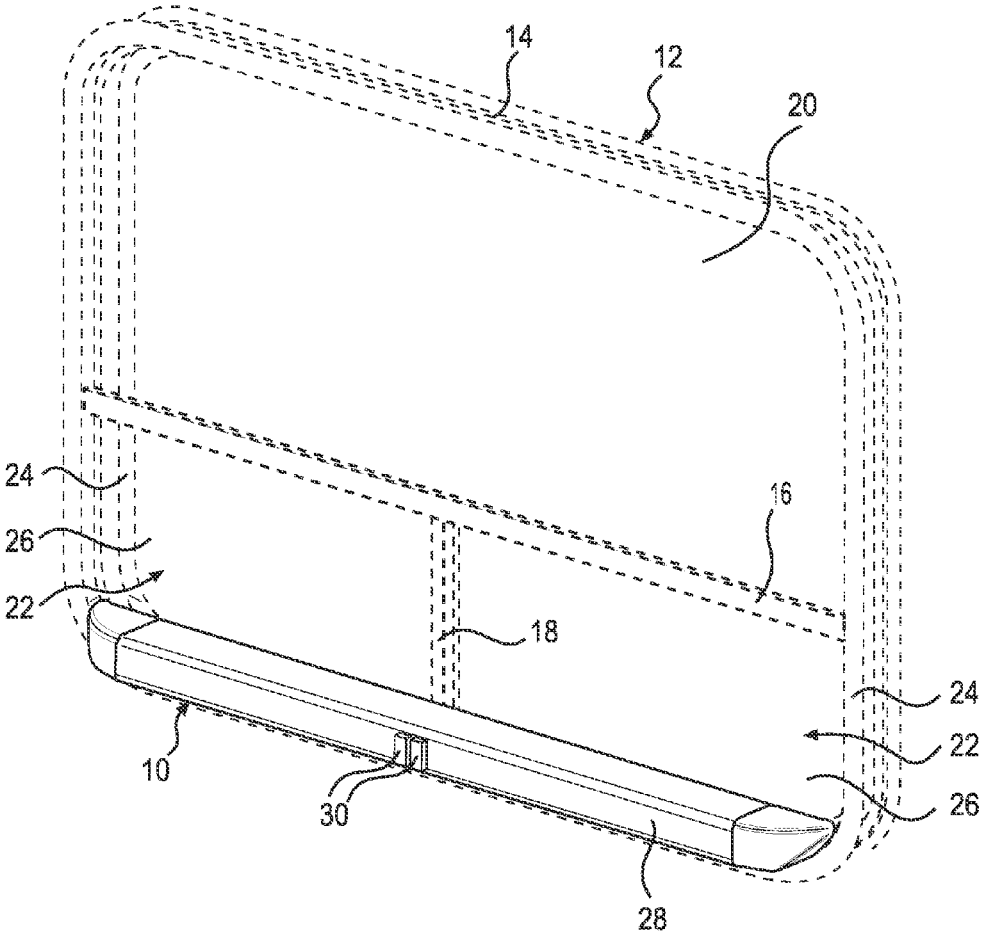
FIG. 1 is a front perspective view (i.e. interview view) of a motorized tilting window operator shown installed on an interior side of a motorized tilting window.
Figure 2:
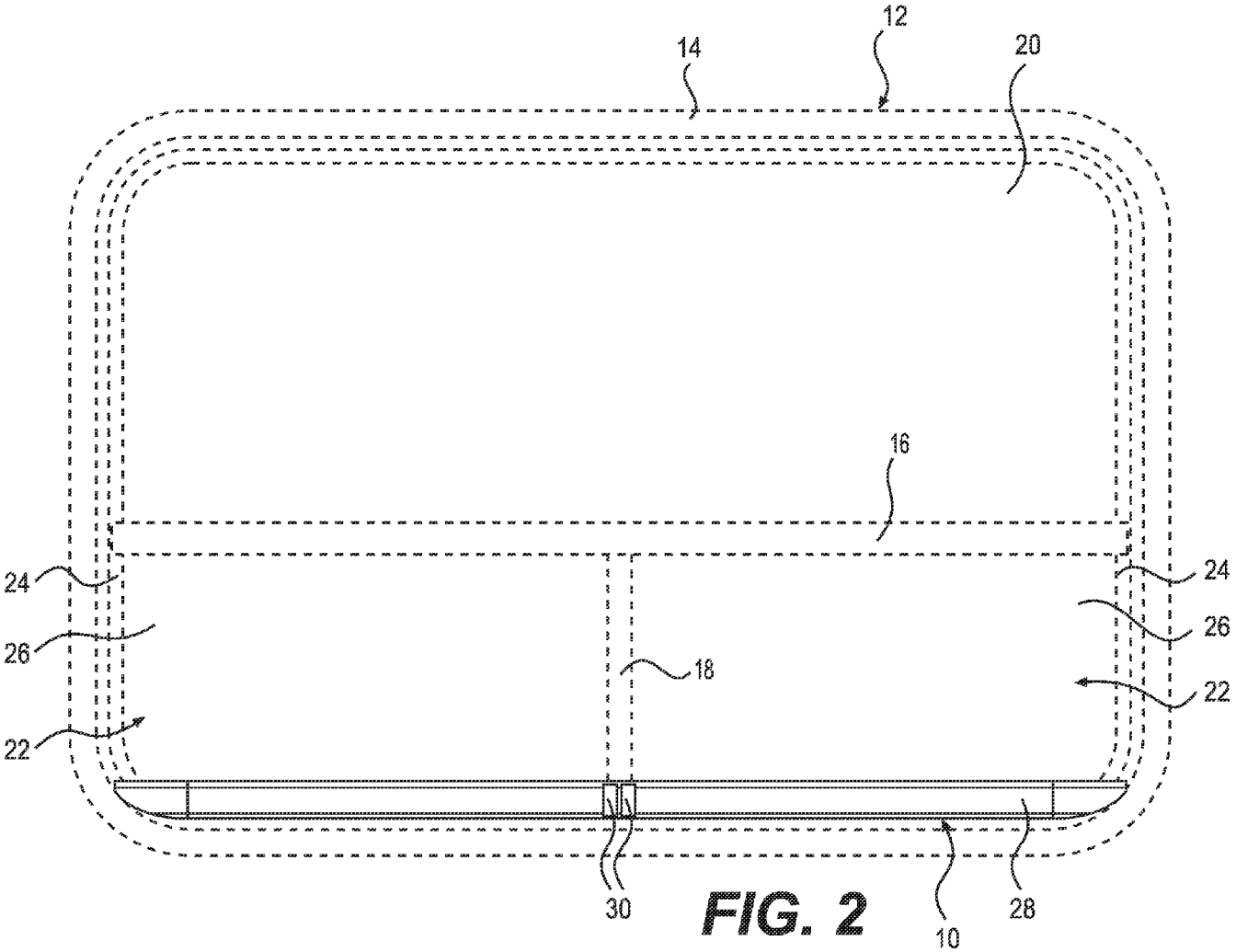
FIG. 2 is a front elevational view of the motorized tilting window operator shown in FIG. 1.
Figure 3:
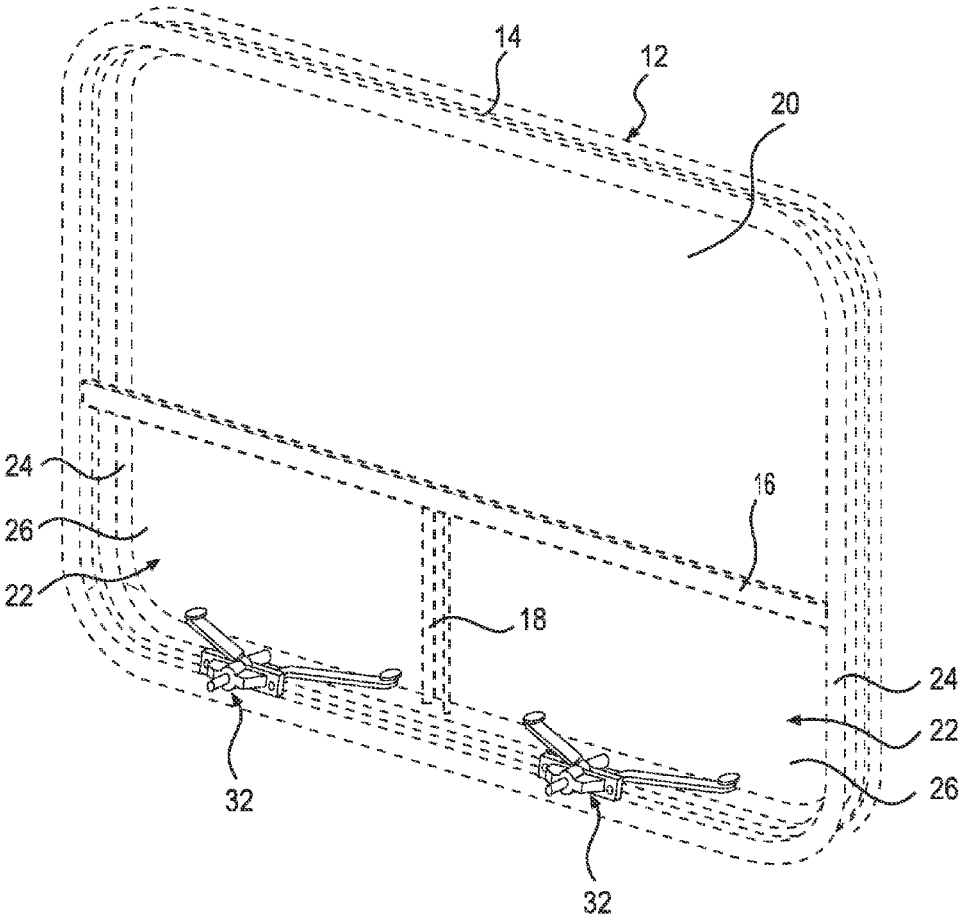
FIG. 3 is front perspective view of the motorized tilting window shown in FIG. 1 with the motorized tilting window operator removed exposing a pair of manual tilting window operators installed on a frame of the tilting window.

A motorized tilting window operator 10 is shown in FIG. 1. The motorized tilting window operator 10 is shown fitted or installed onto a tilting window 12.

The tilting window 12 comprises a window frame 14. The window frame 14 comprises a horizontal window frame section 16 (i.e. horizontal cross-member) and a vertical window frame section 18 (i.e. vertical divider). The tilting window 12 comprises a fixed window pane 20 (i.e. bow window) and two (2) tilting windows 22 each comprising a window sash 24 and a window pane 26.

Figure 12:
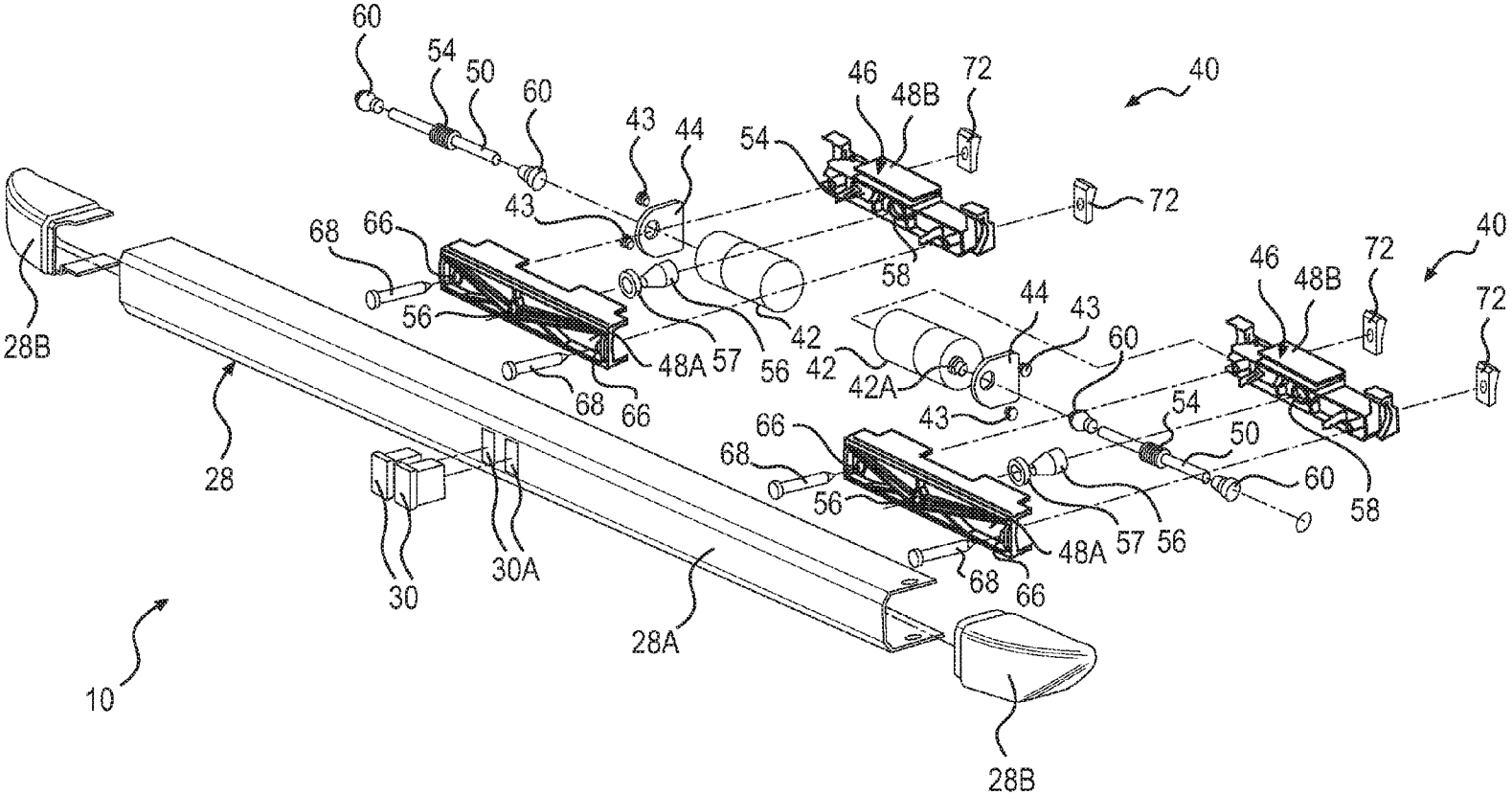
FIG. 12 is an exploded front perspective view of the motorized tilting window operator shown in FIG. 5.

The motorized tilting window operator 10 comprises a cover 28 provided with two (2) finger operated switches 30 (e.g. toggle switches) for independently operating each tilting window 22. The switches 30 fit into slots 30A (FIG. 12).

Figure 5:
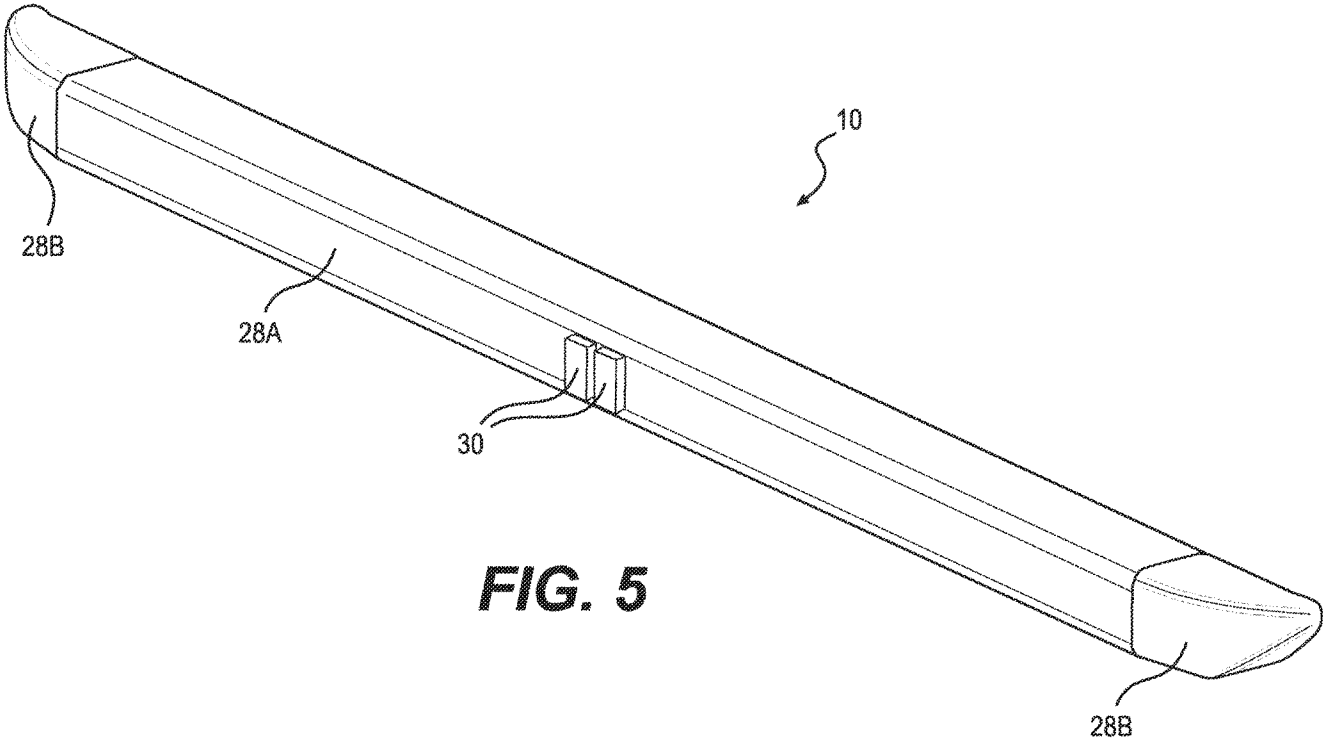
FIG. 5 is a front perspective view of only the motorized titling window operator shown in FIG. 1.
Figure 6:
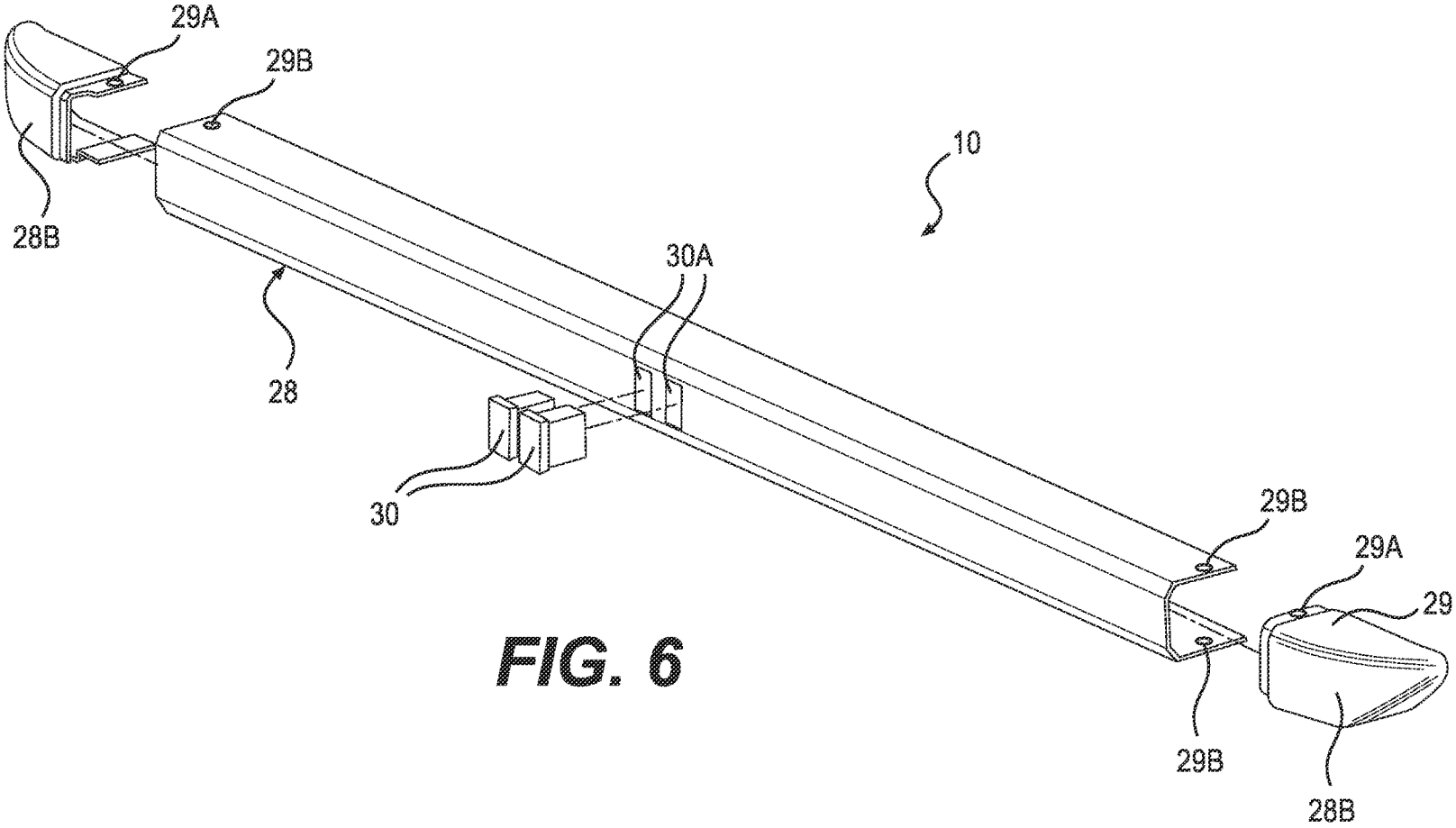
FIG. 6 is an exploded front perspective view of the motorized titling window operator shown in FIG. 5.

The cover 28 comprises a center channel-shaped cover section 28A and two (2) end caps 28B, as shown in FIGS. 5 and 6, The end caps 28B each comprise a flange 29 (FIG. 6) provided with a set of upper and lower round-shaped protrusions 29A configured to snap fit into a set of upper and lower through holes provided near each edge of the center channel-shaped cover section 28A to assemble the end caps 28B onto the center channel-shaped cover section 28A.

Figure 4:
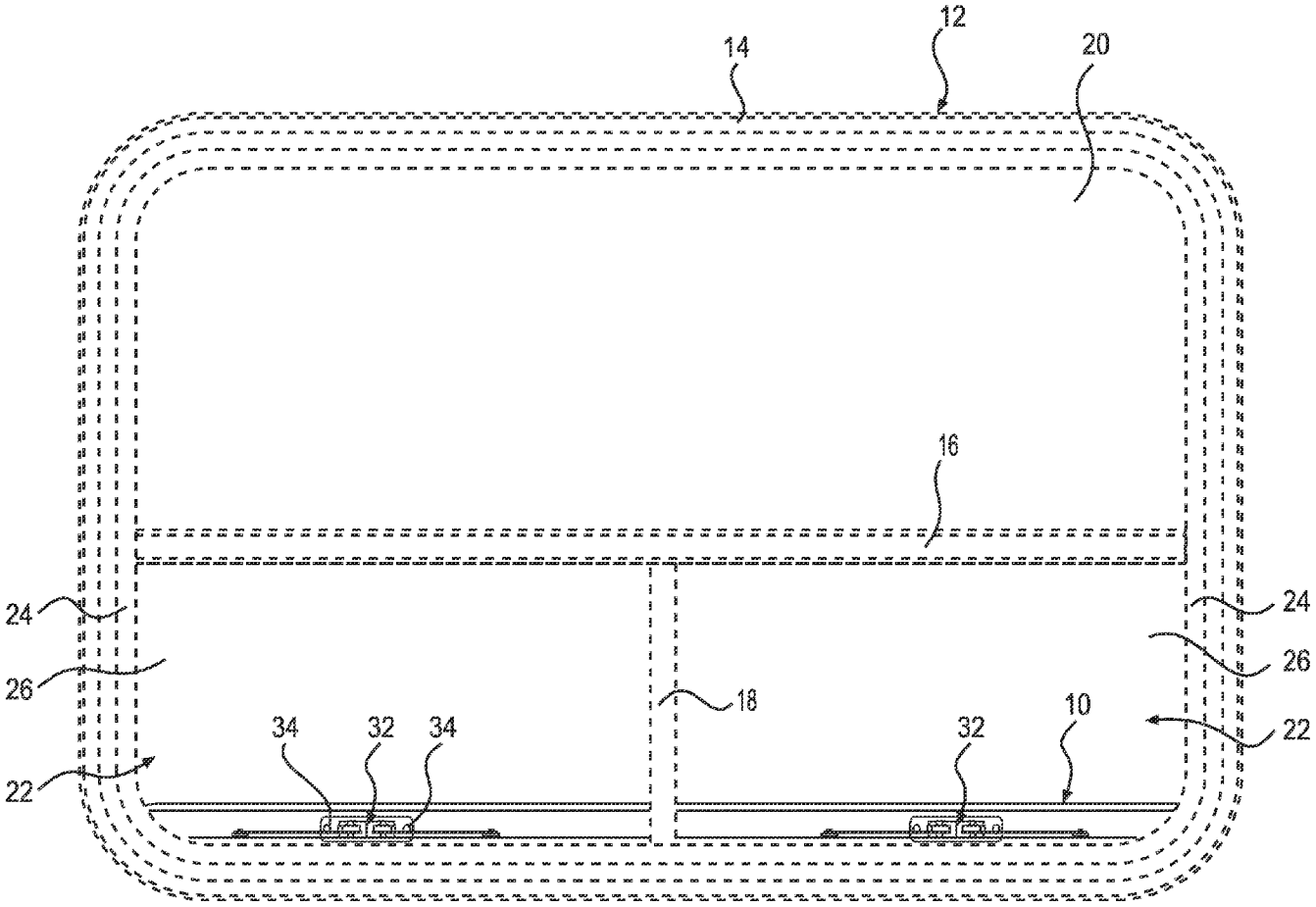
FIG. 4 is a rear elevational view (i.e. exterior view) of the motorized tilting window operator shown in FIG. 1, installed on the interior side of the motorized tilting window, and viewed from the exterior side of the motorized tilting window.
Figure 7:
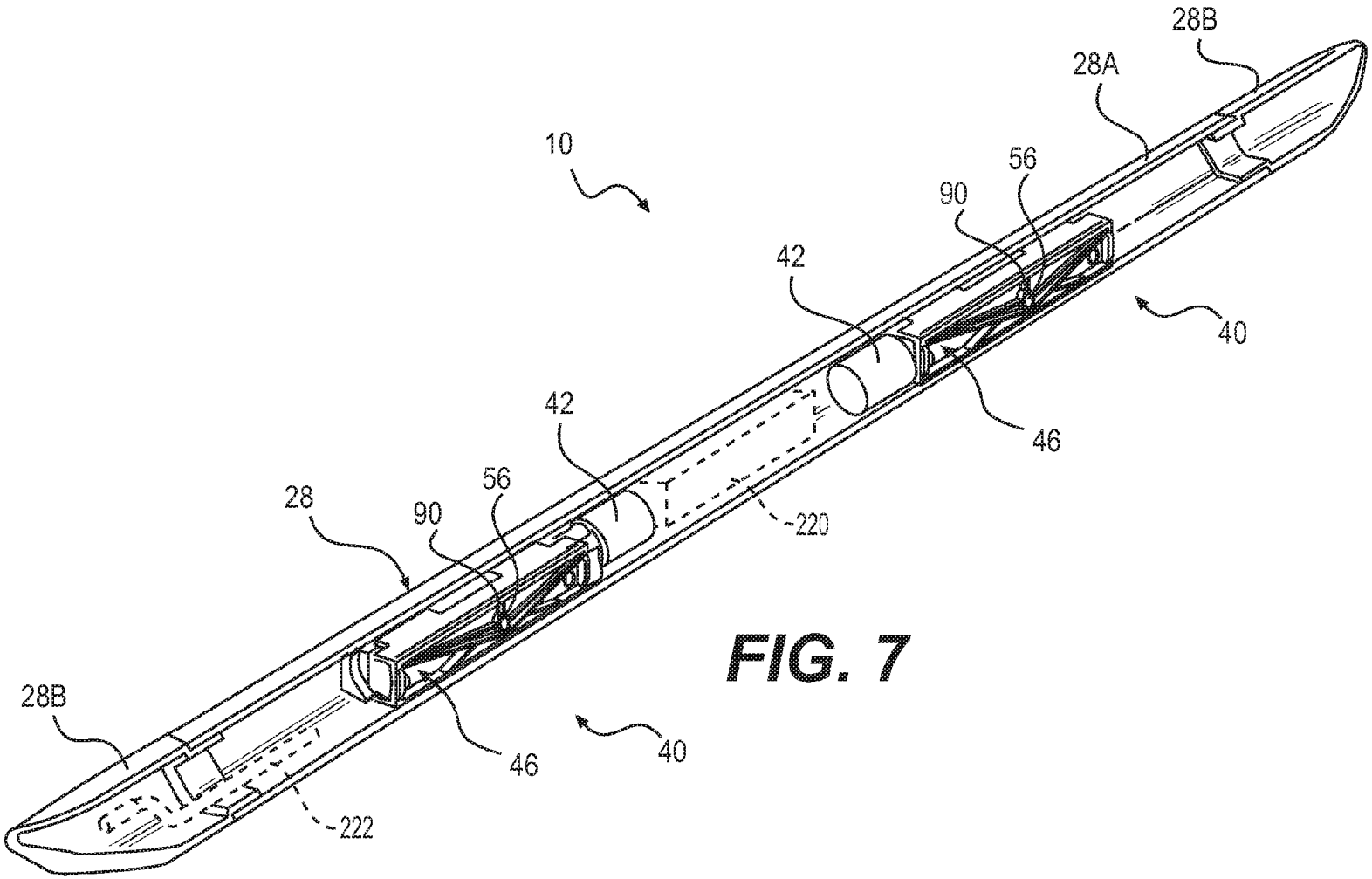
FIG. 7 is a rear perspective view of the motorized tilting window operator shown in FIG. 5.
Figure 9:
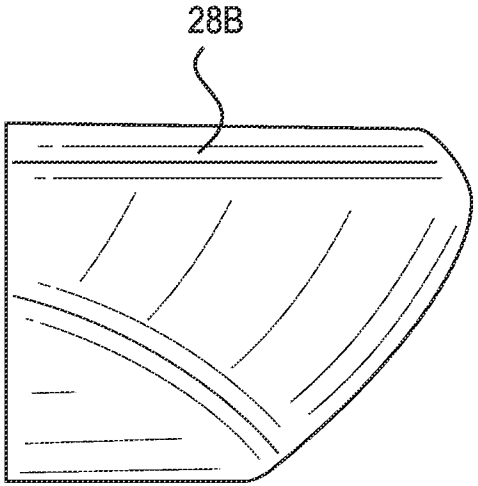
FIG. 9 is an enlarged front elevational view of the right side end cap of the motorized tilting window operator shown in FIG. 5.
Figure 8:
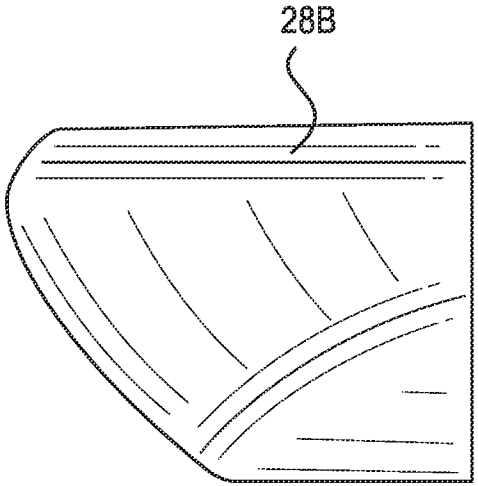
FIG. 8 is an enlarged front elevational view of the left side end cap of the motorized tilting window operator shown in FIG. 5.
Figure 10:
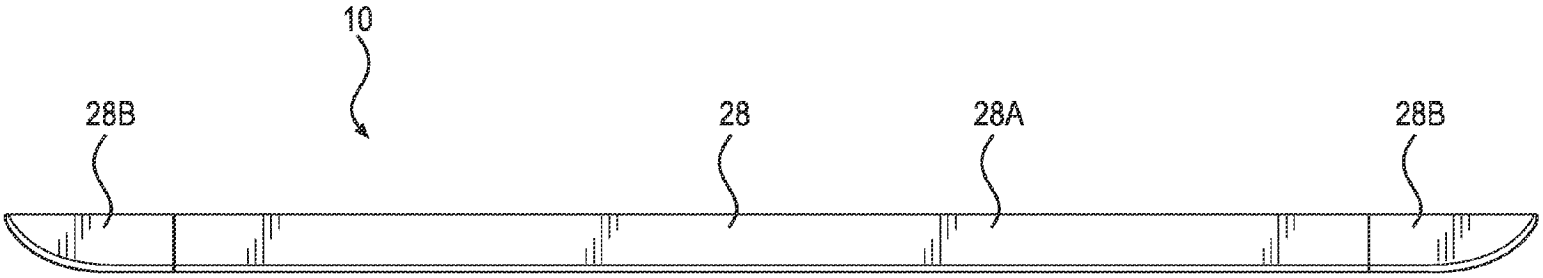
FIG. 10 is a top planar view of the motorized tilting window operator shown in FIG. 5.
Figure 11:
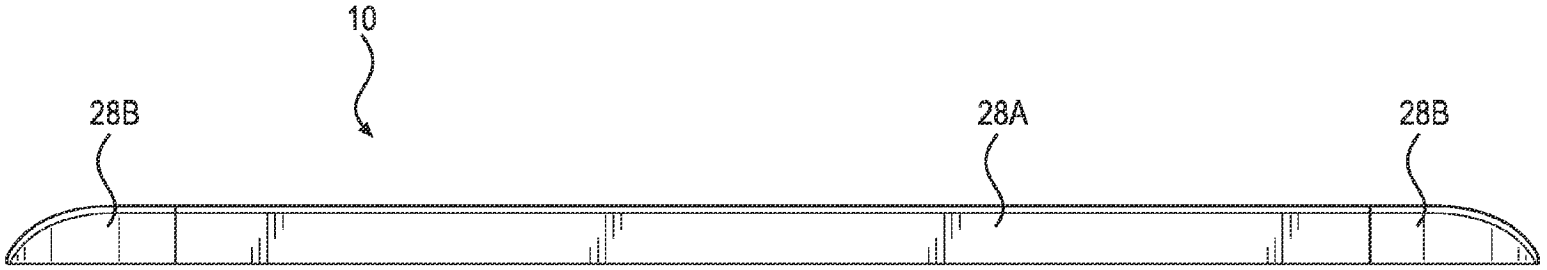
FIG. 11 is a bottom planar view of the motorized tilting window operator shown in FIG. 5.

The motorized tilting window operator 10 connects to a pair of manual tilting window operators 32, as shown in FIG. 4. The manual tilting window operators 32 are connected to the window frame 14 of the tilting window 12 by screws 34. The manual tilting window operators 32 each include a drive shaft 36 fitted with a splined end 38. Specifically, the motorized tilting widow operator comprises two (2) motorized drive units 40, as shown in FIGS. 7 and 12. disposed within the cover 28. The motorized drive units 40 each connect to a respective manual tilting window operators 32, when the motorized tilting window operator 10 is assembled onto the window frame 14 of the tilting window 12.

The motorized tilting window operator 10 can be a separate add on unit to a tilting window 12 already fitted with manual tilting window operators. Alternatively, the motorized tilting window operator 10 can be combined as a unit with the manual tilting window operators 32 to provide an add on unit to a tilting window 12, not yet fitted with any manual tilting window operators or with the existing manual tilting window operators removed to retro fit and upgrade the tilting window. As a further alternative, the motorized tilting window operator 10 connected to the manual tilting window operators 32 are installed together on a tilting window to provided an assembled tilting window unit ready for installation.

Motorized Drive Units

The motorized tilting window operator 10 comprises two (2) motorized drive units 40, as shown in FIGS. 7 and 12. The construction or arrangement of each motorized drive unit 40 is shown in detail in FIG. 13 thru 15.

Figure 14:
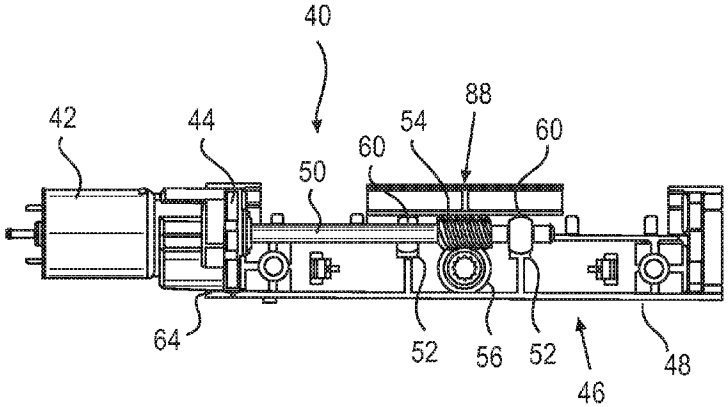
FIG. 14 is a front elevational view of the motorized drive unit shown in FIG. 13.

The motorized drive units 40 each comprise an electric motor 42 fitted with a motor mount plate 44 configured to connect to a respective drive unit 46 (FIG. 14).

The drive unit 46 includes a drive unit housing 48, including a top drive unit housing 48A shown in detail in FIGS. 12 and 16-22, and a bottom drive unit housing 48B shown in detail in FIGS. 12 and 23-29.

Figure 13:
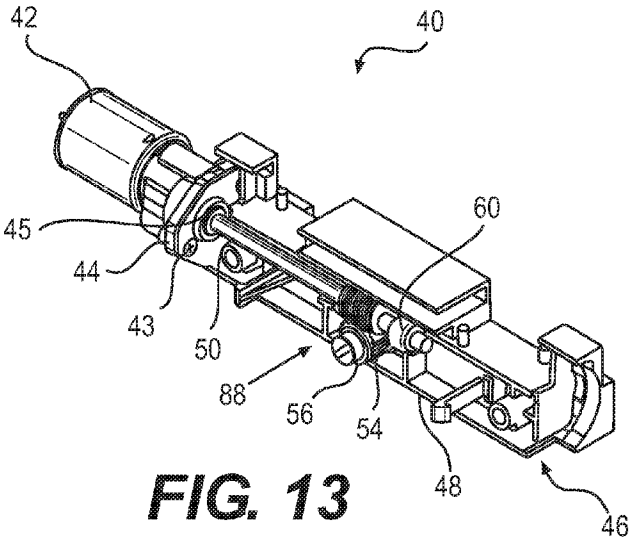
FIG. 13 is a perspective view of one of the motorized drive units of the motorized tilting window operator shown in FIG. 12 with the top drive housing portion removed.
Figure 15:
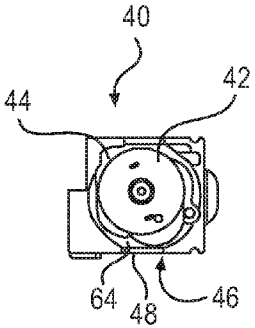
FIG. 15 is a left side elevational view of the motorized drive unit shown in FIG. 14.
Figure 17:
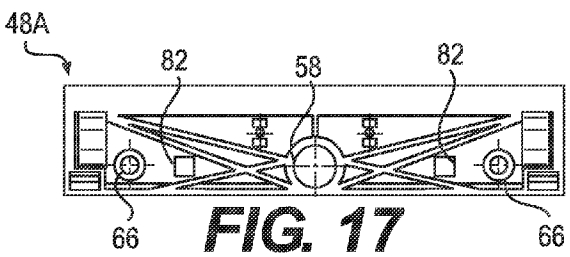
FIG. 17 is a front elevational view (i.e. exterior view) of the top drive housing portion shown in FIG. 16.
Figure 16:
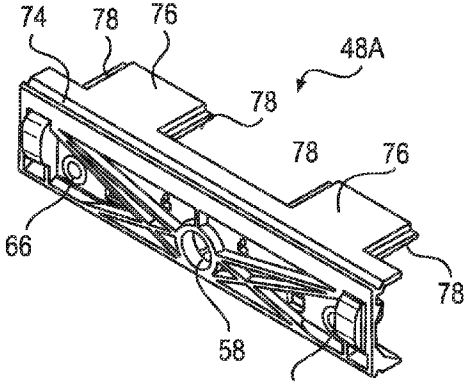
FIG. 16 is a perspective view of the top drive housing portion of one of the motorized drive units shown in FIG. 12.
Figure 18:
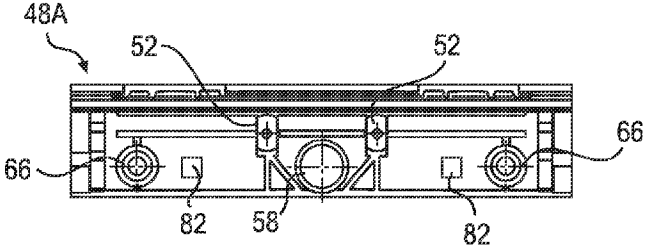
FIG. 18 is rear elevational view (i.e. interior view) of the top drive housing portion shown in FIG. 16.
Figure 19:
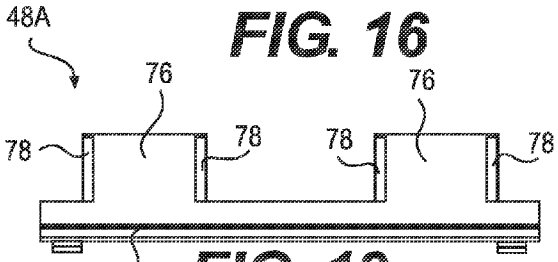
FIG. 19 is a top planar view of the top drive housing portion shown in FIG. 16.
Figure 20:
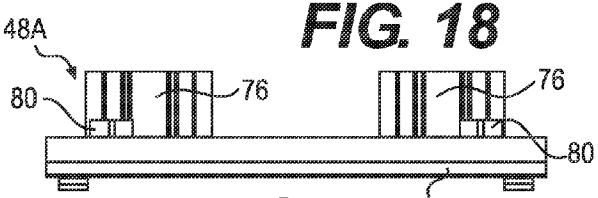
FIG. 20 is a bottom planar view of the top drive housing portion shown in FIG. 16.
Figure 21:
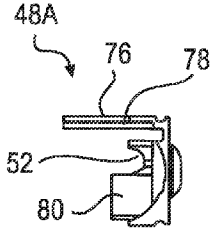
FIG. 21 is a left side elevational view of the top drive housing portion shown in FIG. 16.
Figure 22:
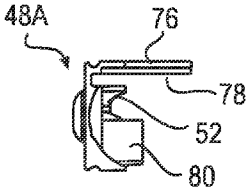
FIG. 22 is a right side elevational view of the top drive housing portion shown in FIG. 16.
Figure 24:
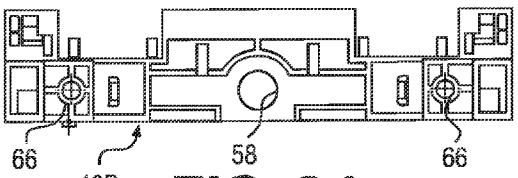
FIG. 24 is a front elevational view (i.e. exterior view) of the bottom drive housing portion shown in FIG. 23.
Figure 25:
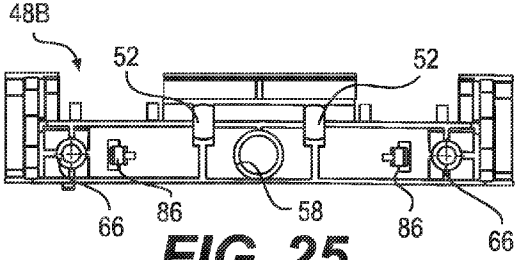
FIG. 25 is rear elevational view (i.e. interior view) of the bottom drive housing portion shown in FIG. 23.
Figure 27:
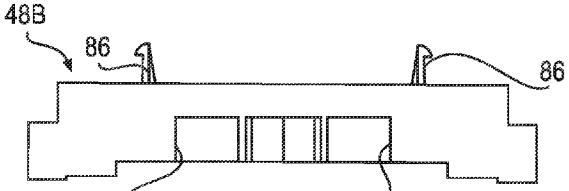
FIG. 27 is a bottom planar view of the bottom drive housing portion shown in FIG. 23.
Figure 23:
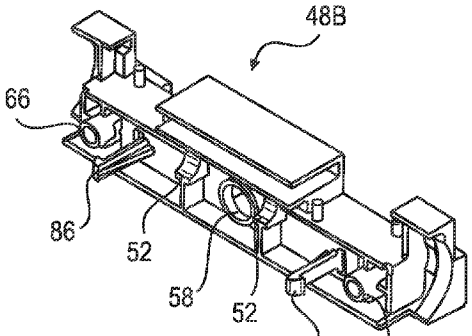
FIG. 23 is a perspective view of the bottom drive housing portion of one of the motorized drive units shown in FIG. 12.
Figure 26:
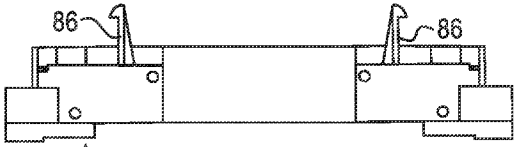
FIG. 26 is a top planar view of the bottom drive housing portion shown in FIG. 23.
Figure 29:
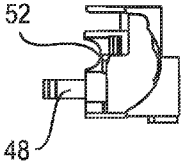
FIG. 29 is a right side elevational view of the bottom drive housing portion shown in FIG. 23.
Figure 28:
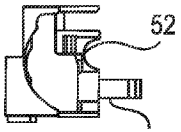
FIG. 28 is a left side elevational view of the bottom drive housing portion shown in FIG. 23.

As shown in FIGS. 13-15, each drive unit 46 comprises a drive shaft 50 rotatably disposed within the drive unit housing 48 in recesses 52. The drive shaft 50 is provided with a worm 54 cooperating with a worm gear 56. The worm gear 56 and worm gear bushing 57 are disposed within a close fitting through hole 58 to provide a rotational axis of the worm gear 56.

The drive shaft 50 is fitted with a set of flanged bearings 60 spaced apart on the drive shaft 50. The flanged bearings 60 are received within the recesses 52 in the drive unit housing 48.

Figure 30:
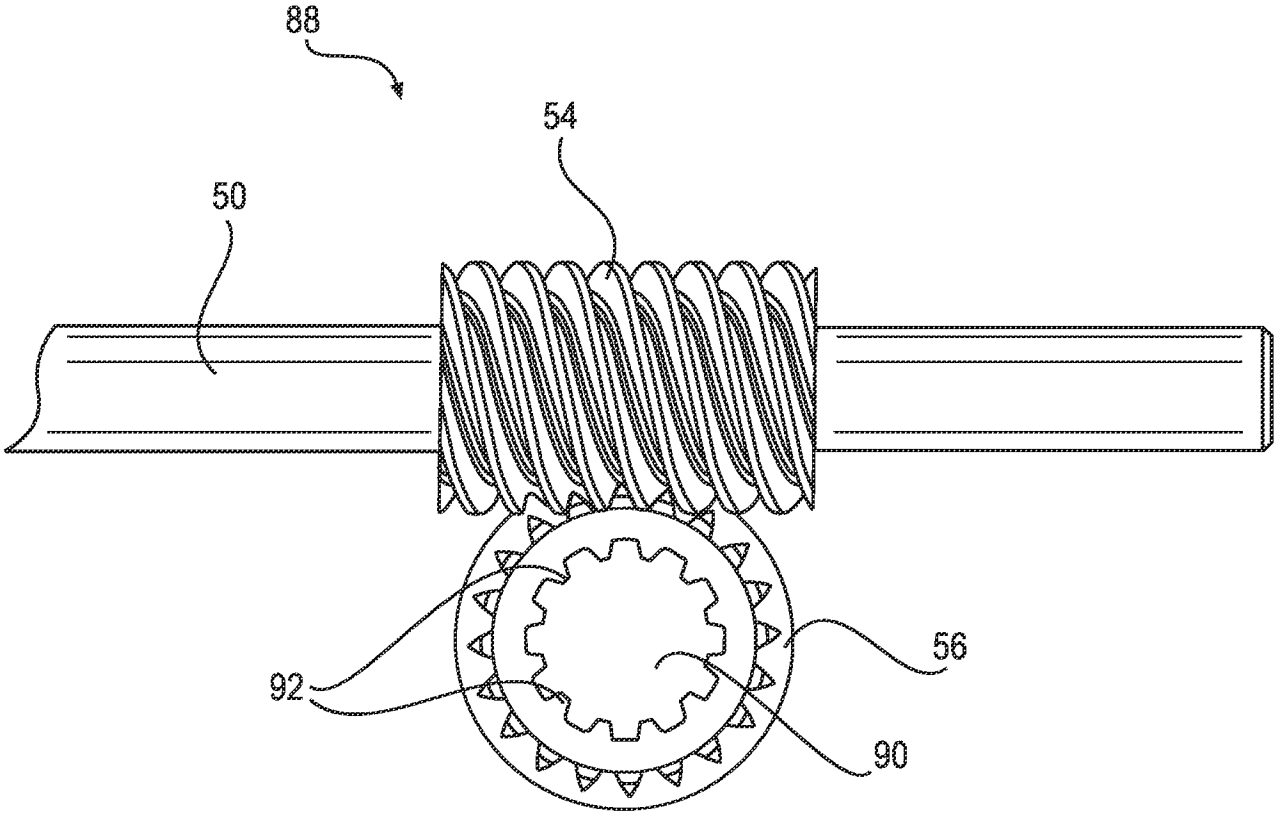
FIG. 30 is a broken away front elevational view of the worm gear drive of the motorized drive unit shown in FIGS. 13-15.

The drive shaft 50 is oriented along a longitudinal axis of the drive unit housing 48, and located on center, or off center (FIG. 14) relative to a height dimension of the drive unit housing 48. The worm gear 56 received within the close fitting through hole 58 is oriented along a width axis (e.g. center, or off center) of the drive unit housing 48. Thus, the axis of rotation of the worm gear 56 is perpendicular relative to the axis of rotation of the drive shaft 50 and worm 54, as shown in FIG. 30.

The motor mount plate 44 is assembled to the electric motor 42 by screw fasteners 43. The motor mount plate 44 is received within a close fitting recess 64 provided on an end of each drive unit housing 48, as shown in FIGS. 14 and 15. The motor mount plate 44 is shaped so as to key and lock within the close fitting recess 64 to prevent rotation between the electric motor 42 and drive unit 46 when the motorized drive unit 40 is operated. Further, the motor mounting plate 44 is fitted with a flange bearing 45 (FIG. 13) for rotatably supporting the drive shaft 50 within the motor mounting plate 44.

The drive shaft 50 can be the motor shaft of the electric motor 42 (i.e. one piece construction). Alternatively, the electric motor 42 can be a separate motor shaft connecting to the drive shaft 50 of the drive unit 46, for example, when assembling the electric motor 42 and drive unit 46 together with a coupling arrangement. As an example, the motor shaft is specially shaped (e.g. provided with a keyway, flat segment, or splined) to couple to the end of the drive shaft 50.

The configuration of the close fitting recesses 52 receiving the bearings 60 provided on drive shaft 50 maintains the drive shaft 50 and worm 54 in rotational alignment and prevents deflection during operation. Further, the close fitting through hole 58 receiving the worm gear 56 maintains the worm gear 56 in rotation alignment during operation. This arrangement maintains the worm 54 and worm gear 56 in alignment and engagement during operation. Specifically, the close fitting recesses 52 capturing bearings 60 prevent deflection of the drive shaft 50 by firmly supporting the drive shaft 50 at positions in proximity and located on opposite sides of the worm 54. The close fitting through hole 58 prevents misalignment of the worm gear 56 by closely confining the outer surfaces (dimensions) of the rotating worm gear 56 during operation. Thus, the assembled drive unit housing 48 configuration provides the necessary structural strength and configuration to provide and maintain the operational integrity, coupling, and alignment of the all drive train components, including the electric motor 42, drive shaft 50, worm 54, and worm gear 56 after assembly of each motorized drive unit 40 during operation.

Drive Unit Housing

Detailed views of the drive unit housings 48A, 48B are shown in FIG. 16 thru 29.

The top drive unit housing 48A is provided with the close fitting through hole 58 for accommodating the bushing 57 on the interior side of the top drive unit housing 48A. The through hole 58 also provides access to the worm gear 56 for inserting a tool into the splined through hole 90 in the worm gear 56 to manually operate the drive unit 46 in the event of a power shortage (e.g. cover 28 is first removed, and then a tool comprising a splined end is inserted into the through hole 58 located in the top drive unit housing 48A, and then into the splined through hole 90 of the worm gear 56). Further, the top drive unit housing 48A is provided with through holes 66 for accommodating bolt fasteners 68 (FIG. 12) for connecting the motorized drive units 40 to the window frame 14. Specifically, the bolt fasteners 68 having outer threaded ends fitting into and through the through holes 66 in the top drive unit housing 48A, the through holes 66 in the bottom drive unit housing 48B, and through holes (not shown) in the window frame 14 fitted with blind fasteners 72 (FIG. 12) having inner threaded holes.

The top drive unit housing 48A is provided with connector portions 76 having flanges 78, connector tabs 80, and square-shaped connector slots 82 for connecting the top drive unit housing 48A to the bottom drive unit housing 48B by a snap fit connection to be described in detail below.

The top drive unit housing 48A is provided with the close fitting recesses 52 (FIGS. 18, 21, and 22) for accommodating the bearings 60 of the drive shaft 50.

The bottom drive unit housing 48B is provided with the close fitting through hole 58 for accommodating the worm gear 56 on the interior side of the bottom drive unit housing 48B. Further, the bottom drive unit housing 48B is provided with through holes 66 for accommodating bolt fasteners 68 (FIG. 12) for connecting the motorized drive units 40 onto the window frame 14. The through holes 66 in the bottom drive unit housing 48B align with the through holes 66 in the top drive unit housing 48A.

The bottom drive unit housing 48B is provided with connector slots 84 for receiving the connector portions 76 of the top drive unit housing 48A. In addition, the bottom drive unit housing 48A is provided with connector prongs 86 configured to snap fit into the square-shaped connector slots 82 of the top drive unit housing 48A.

The bottom drive unit housing 48B is provided with the close fitting recesses 52 (FIGS. 23, 28, and 29) for accommodating the bearings 60 of the drive shaft 50.

Worm Gear Drive

The motorized drive units 40 each comprise a worm gear drive 88 comprising the drive shaft 50 fitted with the worm 54 cooperating with the worm gear 56, as shown in FIGS. 13-15.

A detailed view of the worm gear drive 88 is shown in FIG. 30. The rotational axis of the drive shaft 50 and worm 54 is perpendicular relative to the axis of rotation of the worm gear 56. Further, the drive shaft 50 is rotatable supported by the set of bearings 60, and worm gear 56 is rotatably supported by the close fitting through hole 58 to maintain alignment and full engagement of the worm 54 and worm gear 56 of the worm gear drive 88 during operation of the motorized drive unit 40.

The worm gear 56 is provided with a splined socket 90 (i.e. output) to connect with the splined end 38 of the respective drive shafts 36 (i.e. input) of each manual tilting window operator 32. Specifically, each motorized drive unit 40 is installed on top of each manual tilting window operator 32 with the splined socket 90 of the worm gear 56 interconnecting with the splined end 38 of the respective manual tilting window operator 32 to provide an operational connection between each motorized drive unit 40 and each manual tilting window operator 32.

Cover

Figure 37:
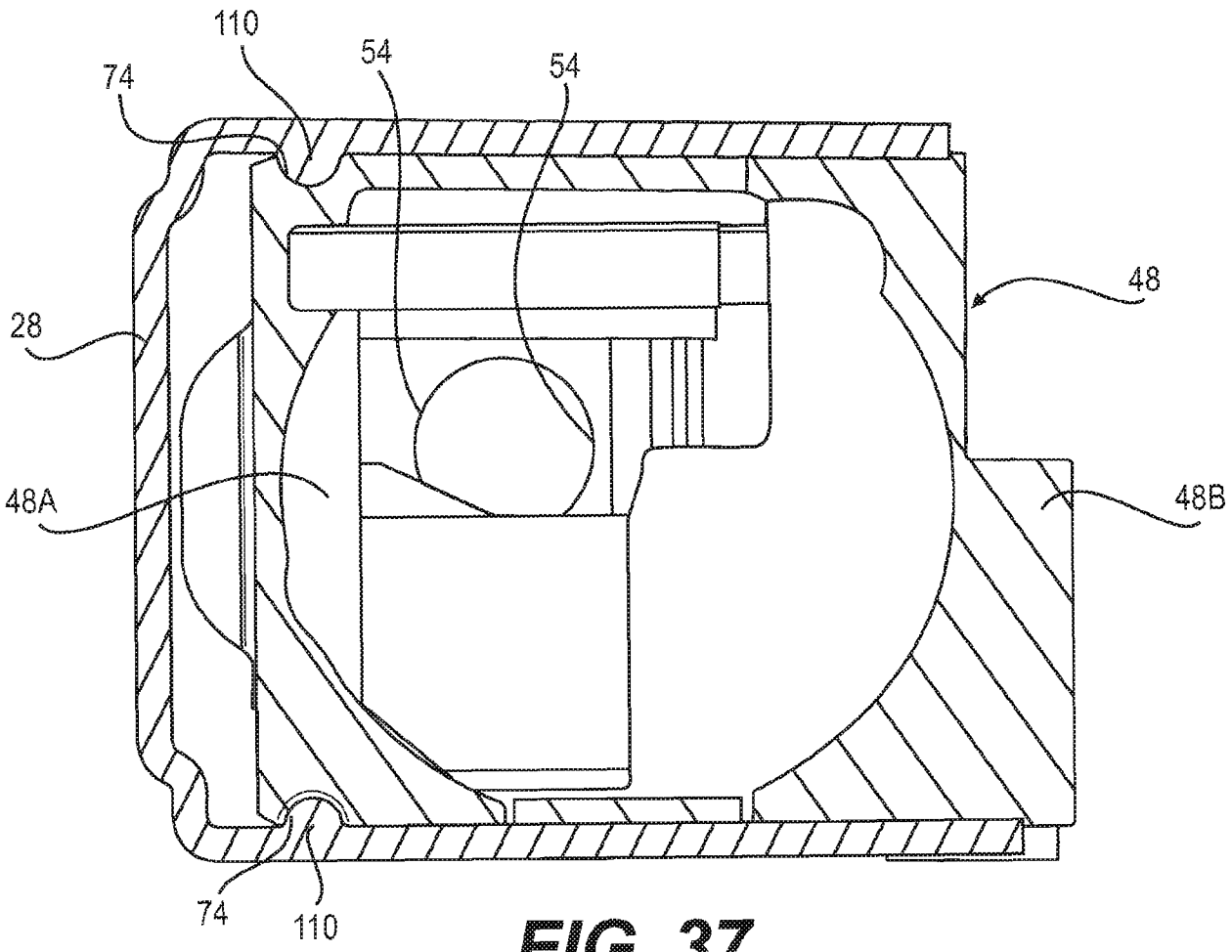
FIG. 37 is a cross-sectional view of the cover connecting to one of the drive unit housings of the motorized tilting window operator shown in FIG. 12.
Figure 39:
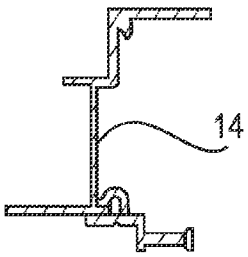
FIG. 39 is a cross-sectional view of the window frame, as indicated in FIG. 38.
Figure 40:
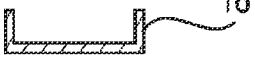
FIG. 40 is a cross-sectional view of the window frame, as indicated in FIG. 38.
Figure 41:
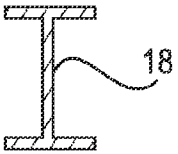
FIG. 41 is a cross-sectional view of the window frame, as indicated in FIG. 38.
Figure 38:
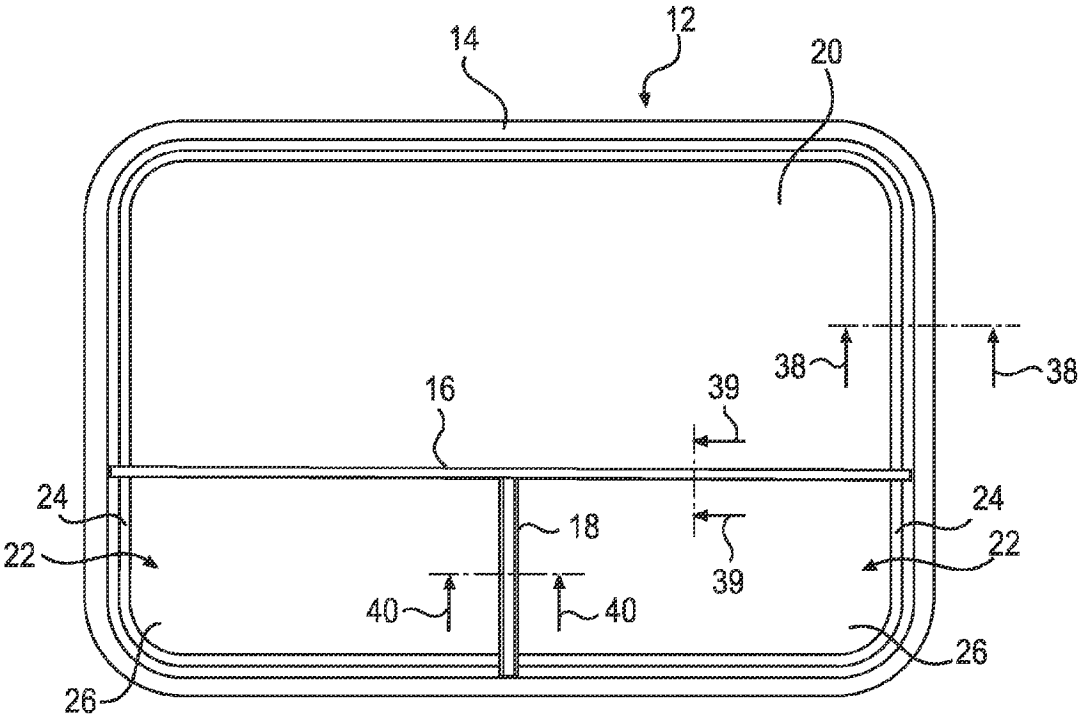
FIG. 38 is a front elevational view (i.e. interior view) of the window frame of tilting window shown in FIGS. 1 and 43.
Figure 42:
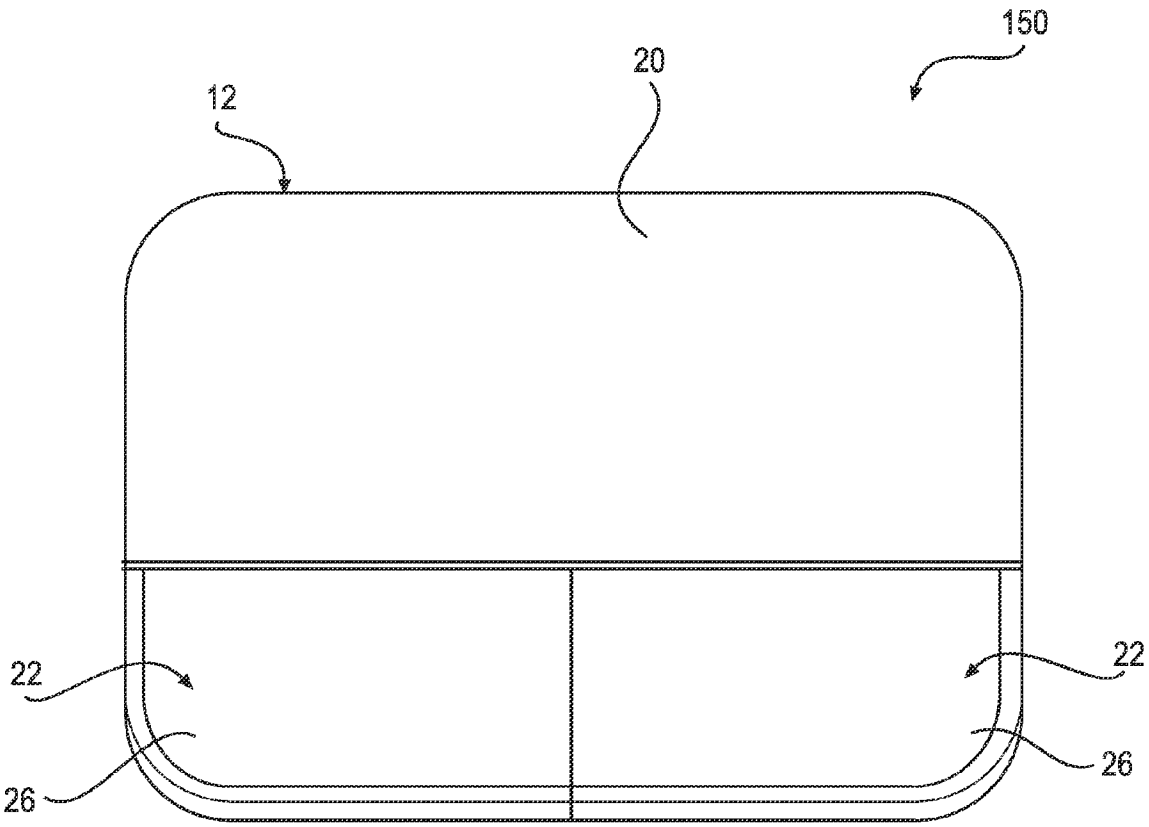
FIG. 42 is a rear elevational view (i.e. exterior view) of the motorized tilting window shown in FIGS. 1 and 43.

The top drive unit housing 48A is provided with upper and lower longitudinal grooves 74 (FIGS. 19 and 20) for connecting with protrusions 110 (FIG. 37) located inside the cover 28 (e.g. to provide a snap fit connection) to the drive unit housings 48 of the motorized drive units 40. This removable cover arrangement will be described in more detail. As shown in FIG. 37, the cover 28 is a channel-shaped cover 28 configured to removably connect to and cover the motorized drive units 40 (FIGS. 19 and 20) of the tilting window when the motorized tilting window operator 10 is installed onto the tilting window. The cover 28 includes upper and lower protrusions 110 configured to snap fit into the upper and lower grooves 74 of each drive unit housing 48 to removably connect the cover 28 to the drive units 40. The protrusions 110 are rounded convex-shaped protrusions 110 and the grooves 74 are corresponding rounded concave-shaped grooves 74. The protrusions 110 are oriented and extend in a direction along the length of the cover 28. The grooves 74 are oriented and extend along the length of each drive unit housing. As shown in FIG. 37, the grooves 74 of the drive unit housings 48 are located adjacent to a front side of each drive unit housing 48 and protrusions 110 of the cover 28 are located adjacent to a closed front end of the cover 28.

Electrical System

The motorized tilting window operator 10 can be wired to the power supply or system of the vehicle or structure for operating the electrical motor 42. The electrical motor 42 can be wired and controlled by one of the switches 30. Alternatively, the motorized tilting window operator 10 can be powered independently. Further, a backup battery pack can be added to allow motorized operation during a power outage.

The electric motors 42 are configured to operate in both directions by control of the switches 30 (e.g. switches 30 configured to toggle from a neutral unpowered position to two (2) operational positions, including a forward or a reverse position to open and close the tilting windows 22).

Assembly

The drive unit housings 48A, 48B are configured and designed to facilitate quick assembly of each drive unit 46 without any tools required for assembly (e.g. the drive unit housings 48A, 48B are configured to snap fit together). Specifically, with the bottom drive unit housing 48B separated from the top drive unit housing 48A, the worm gear 56 and bushing 57 are installed into the through hole 58 provided in the bottom drive unit housing 48B. Then, the drive shaft 50 is installed into the bottom drive unit housing 48B. Specifically, the bearings 60 of the drive shaft 50 are inserted into the recesses 60 while inserting the motor mounting plate 44 of the electric motor 42 into the recess 64.

The top drive unit housing 48A is then snap fit onto the bottom drive unit housing 48B to complete the assembly.

The motorized drive units 40 are then installed onto both the manual tilting window actuators 32 and window frame by fitting the splined socket 90 of the worm gears 56 of the motorized drive units 40 over the splined ends 38 of the drive shafts 36 of the manual tilting window operators 32. When the motorized drive units 40 are fully seated over the manual tilting window operators, the motorized drive units 40 are attached to the window frame 14 using bolt fasteners 68 (FIG. 12). Specifically, the bolt fasteners are inserted into and through the through holes 66 (FIG. 12) provided in the drive unit housings 48A, 48B, and then inserted into through holes 70 provided in the window frame 14. The through holes 70 provided in the window frame 14 are fitted with blind fasteners 72 (FIG. 12), which have threaded holes for receiving the threaded ends of the bolt fasteners 68 for securing the motorized drive units 40 onto the window frame 14.

Figure 33:
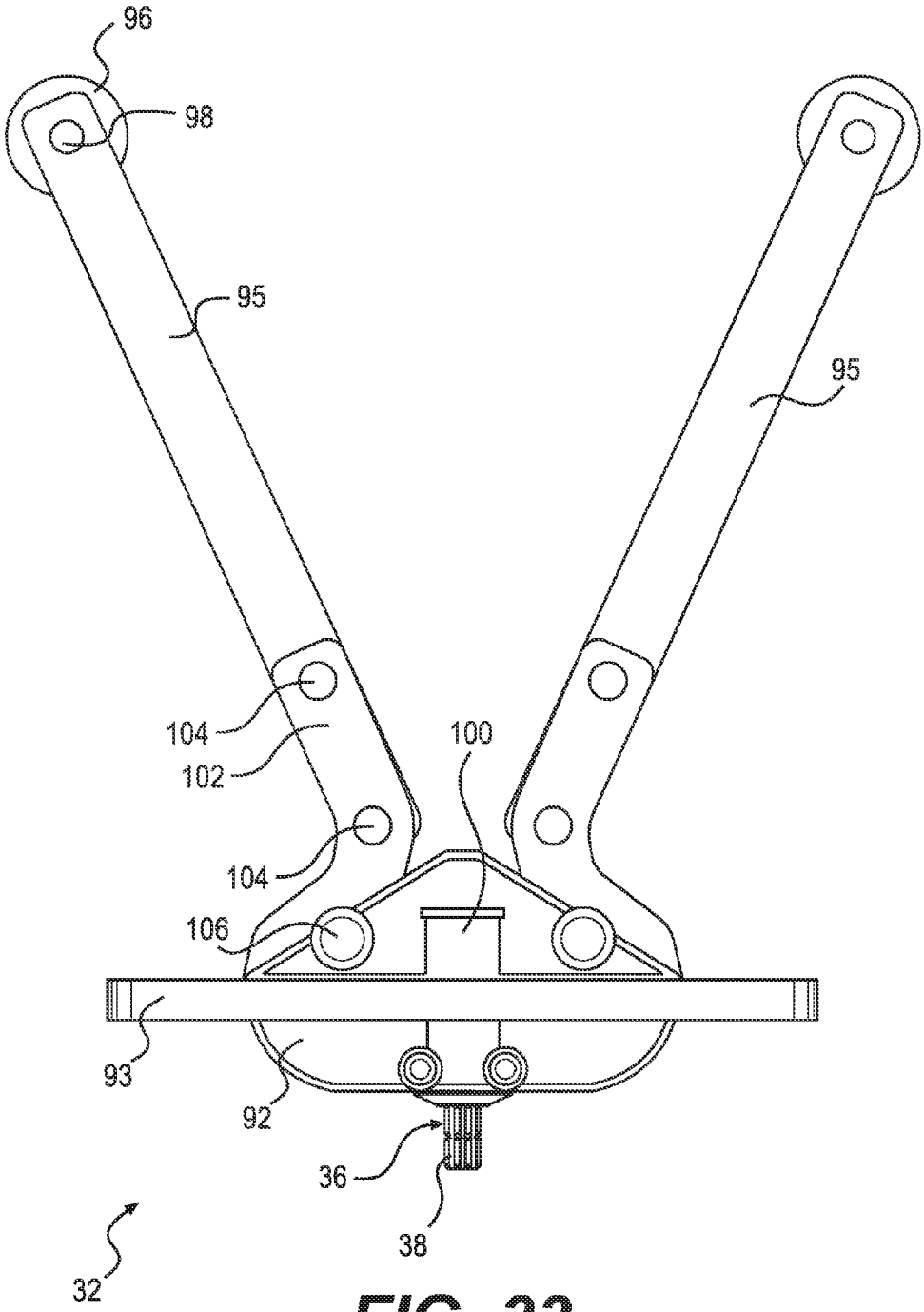
FIG. 33 is a top planar view of the manual tilting window operator shown in FIG. 32.
Figures 34, 35, 36:
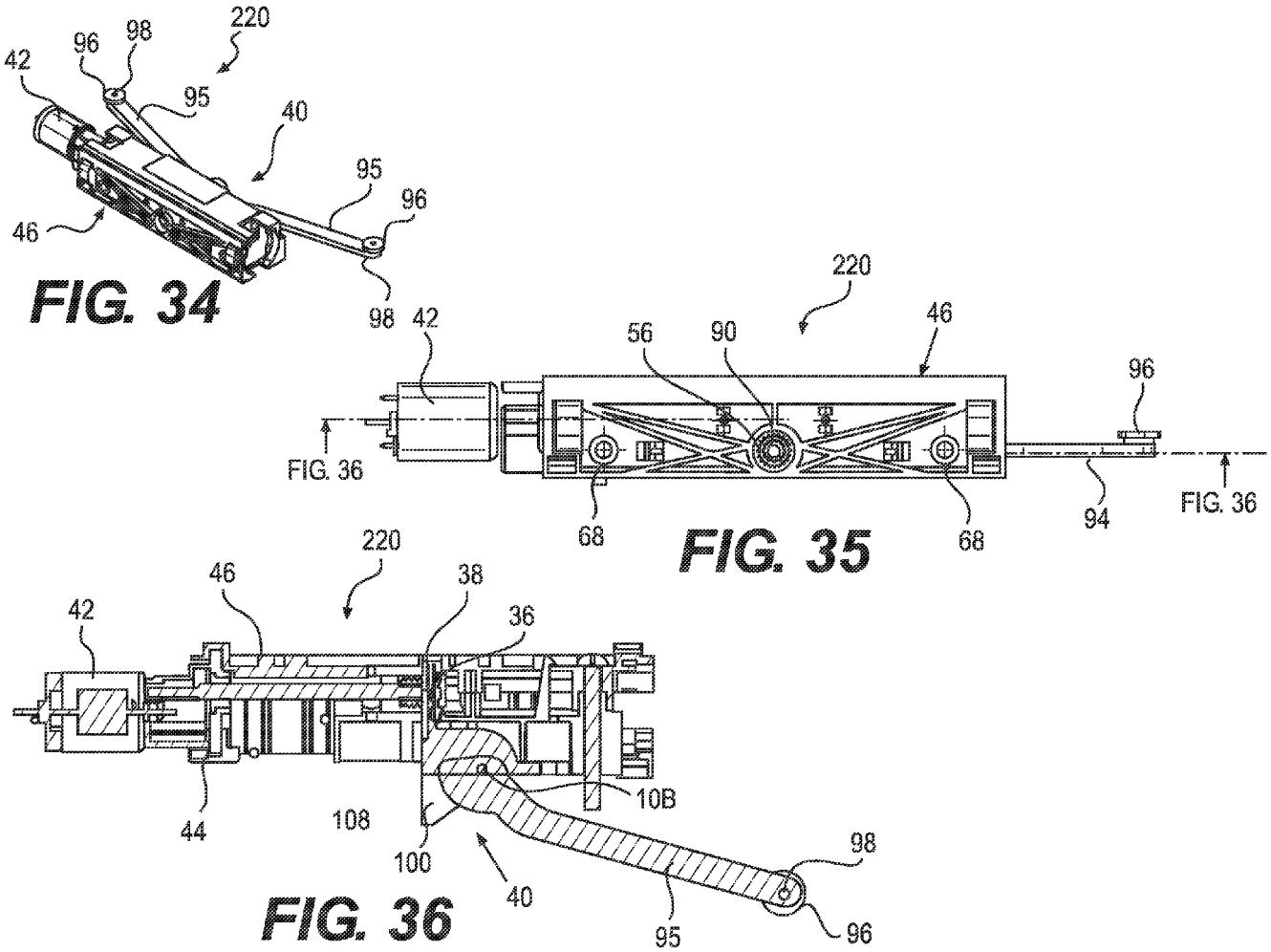
FIG. 34 is perspective view of a combined motorized/manual tilting window drive unit comprising the motorized tilting window operator shown in FIGS. 13-15 connected to one of the manual tilting window operators shown in FIGS. 32 and 33.
FIG. 35 is a front elevational view of the combined motorized/manual tilting window drive unit shown in FIG. 34.
FIG. 36 is a top elevational view of the combined motorized/manual tilting window drive unit shown in FIG. 34.

A manual tilting window operator 32 is shown in FIG. 33. The manual tilting window operator 32 comprises a crank actuator 92 provided with the drive shaft 36 having the splined end 38. The crank actuator 92 is provided with a mounting plate 93 for mounting to the frame of the tilting window. A pair of actuator arms 95 each include a rotating wheel 96 connected to the free ends of the arms 95 via pins 98. The opposite ends of the arms 95 are connected to actuating arms 102 via pins 104. The actuating arms are pivotably connected to the crank actuator 92 via pins 106. The crank actuator includes a drive shaft housing 100 for accommodating the drive shaft 36.

Combined Motorized Tilting Window Operator

Figure 31:
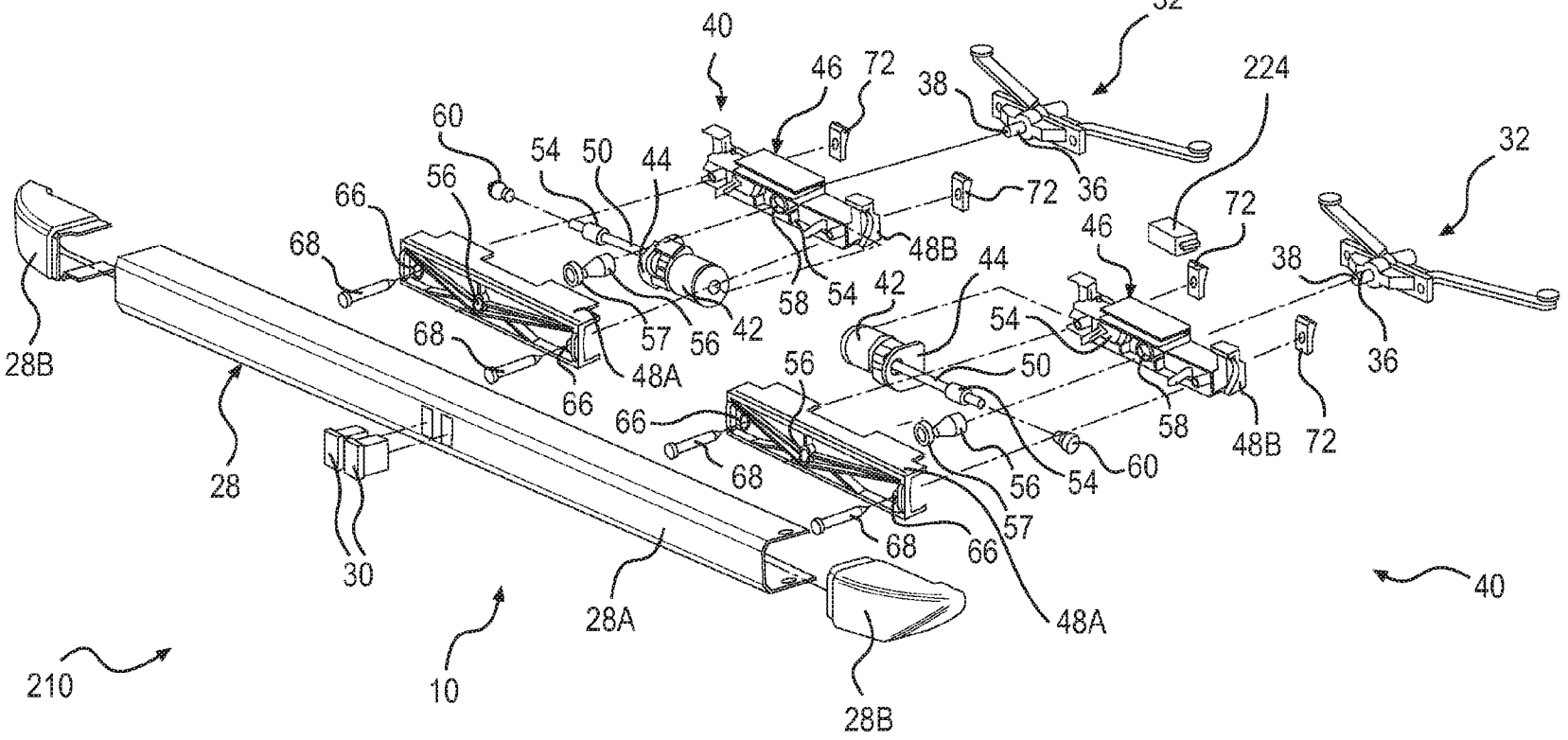
FIG. 31 is an exploded front perspective view of the motorized tilting window operator shown in FIG. 5 in combination with two (2) manual tilting window operators.
Figure 32:
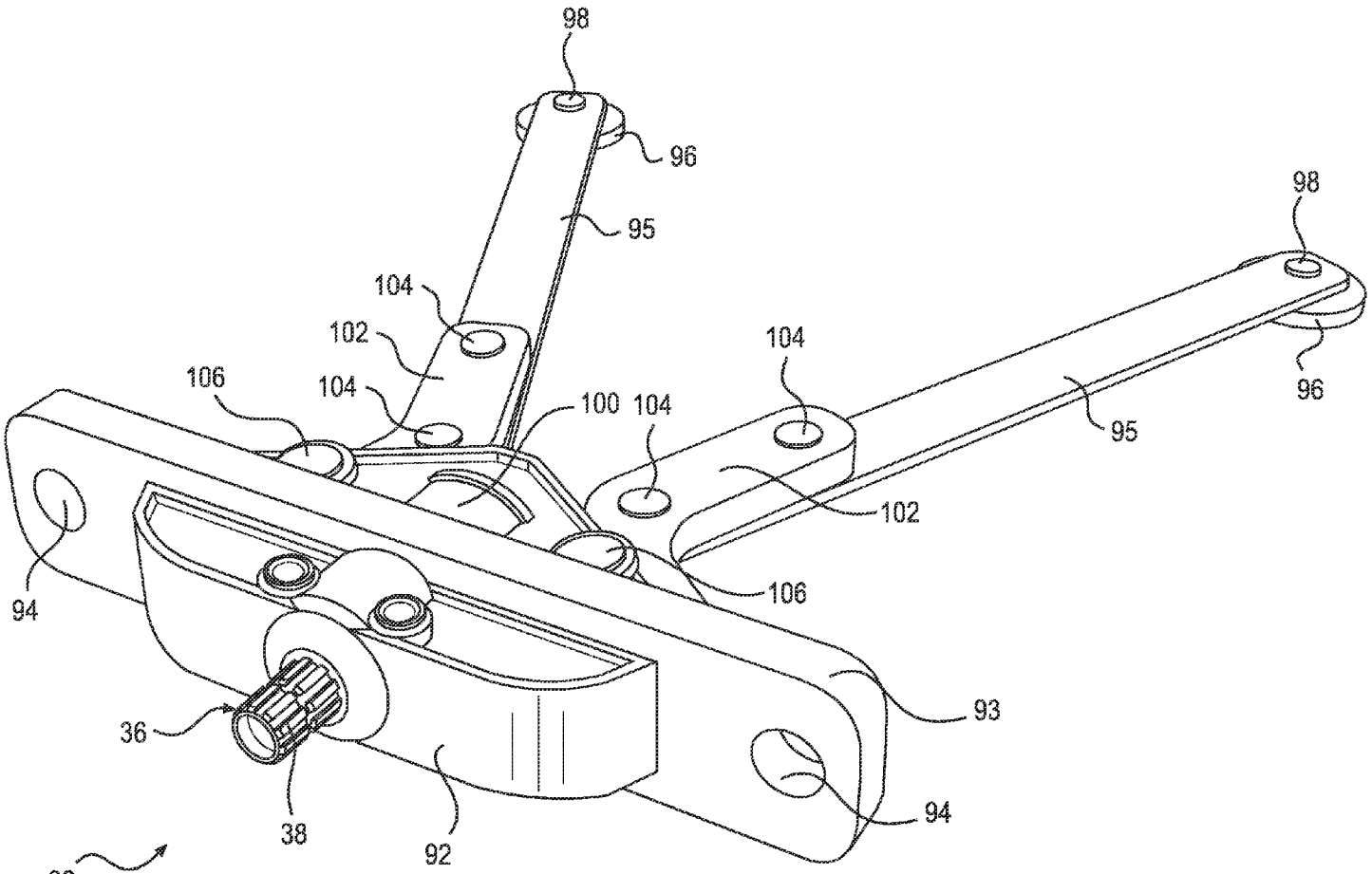
FIG. 32 is an enlarged perspective view of one of the manual tilting window operators shown in FIG. 31.

The combined motorized/manual tilting window operator 210 is shown in FIG. 31. The combined motorized tilting window operator 210 comprises the motorized tilting window operator 10 (FIG. 12) connected together with one or more manual tilting window operators 32 (FIG. 32). Specifically, the motorized tilting window operator 10 and manual tilting window operators 32 can be assembled together as a unit to create the combined motorized/manual tilting window operator 210. This combination can be applied to a new tilting window having no operator device or arrangement yet installed, or to an existing tilting window with the existing tilting window operator removed in advance for installation of the new combined motorized/manual tilting window operator. The manual tilting window operator 32 (FIG. 32) comprises a mounting plate 93 having a set of through holes 94 for securing the manual tilting window operator 32 to a window frame using a fastener.

Accessories

The motorized tilting window operator 10 and/or tilting window can be provided with a variety of accessories.

A. Battery Pack

A battery pack 220 (e.g. rechargeable battery pack) can be added. For example, a battery pack can be fitted into the cover 28, and access to the battery pack can be provided by removing an end cap 28B. The motorized tilting window operator is normally wired to the power supply or system of the application (e.g. RV, trailer, truck cab). The battery pack can provide backup power in the event of power failure of the power supply or system. For example, the battery pack is wired to the motorized tilting window operator in a manner to provide powered operation of the motorized tilting window operator 10 even in the event of a power outage.

B. Tool

A tool 222 (e.g. hand crank with splined end) can be added. For example, the tool 222 is stored inside the cover 28, and access to the tool 222 is provided by removing the cover 28 itself, or removing an end cap 28B. With the cover 28 removed from the motorized drive units 40 (i.e. connected together by snap fit connection), the splined end of the tool can be fitted into the through hole 56 of the top drive unit housing 48A, and then into the splined socket 90 of the worm gear 56. By hand cranking the tool 222, the motorized drive unit 40 is manually operated to open or close the respective tilting window 22.

C. Rain/Wind Detector

A rain/wind detector 224 (FIG. 31) can be provided on the motorized tilting window operator 10 and/or on the tilting window 12, and/or on the vehicle or structure. The rain/wind detector can be wired or wirelessly linked to the motorized tilting window operator 10 in a manner to close the tilting windows 22 automatically in the event of rain being detected and/or wind detected exceeding a predetermined wind speed.

D. Low Battery Voltage Detector

A low battery voltage detector can be provided on the motorized tilting window operator 10 and/or on the tilting window 12, and/or on the vehicle or structure. The low battery voltage detector can be wired or wirelessly linked to the motorized tilting window operator 10 in a manner to close the tilting windows 22 automatically in the event of low batter voltage detected.

E. Backlit Switches

The switches 30 (FIGS. 1, 5 and 6) can be backlit switches so that a user can find same in interior dim lights or lights off conditions.

F. Electroluminescent (EL) Wire

The motorized tilting window operator 10 and/or tilting window 12 can be fitted with electroluminescent wire.

G. Key Fob

The motorized tilting window operator 10 and/or tilting window 12 can be configured to operate using a key fob.

H. Cell Phone Application

The motorized tilting window operator 10 and/or tilting window 12 can be configured to operate using a cell phone application. A computer server is required to provide this capability.

I. Magnetic Window Blind

The window blind 220 (e.g. lower slat) and/or the cover 28 can be fitted with sets of magnets and metal plates (e.g. using adhesive and/or a sticky back adhesive layer with a release liner) so that the window blind 220 and cover 28 removably connect together when fully extended to prevent egress of light between the window blind 220 and cover 28.

J. Software Application

A software application can be provided, for example, for a user's smart phone, tablet, or personal computer. The software application is configured to allow the user to operate the motorized tilting window operator 10 and tilting window 12 remotely. A computer operated control unit or module can be added for this purpose.

Operation

Figure 43:
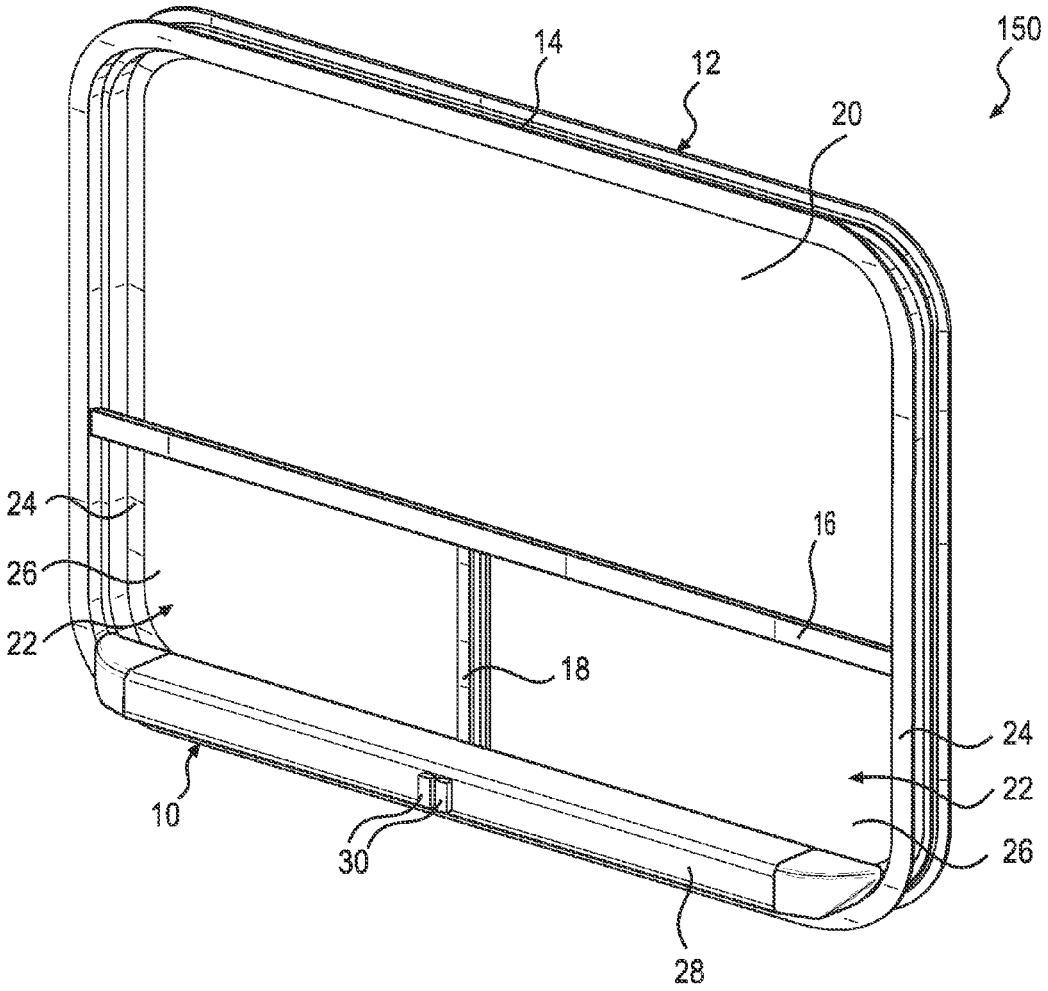
FIG. 43 is a front elevational view (i.e. interior view) of the motorized tilting window shown in FIGS. 1 and 42.
Figure 44:
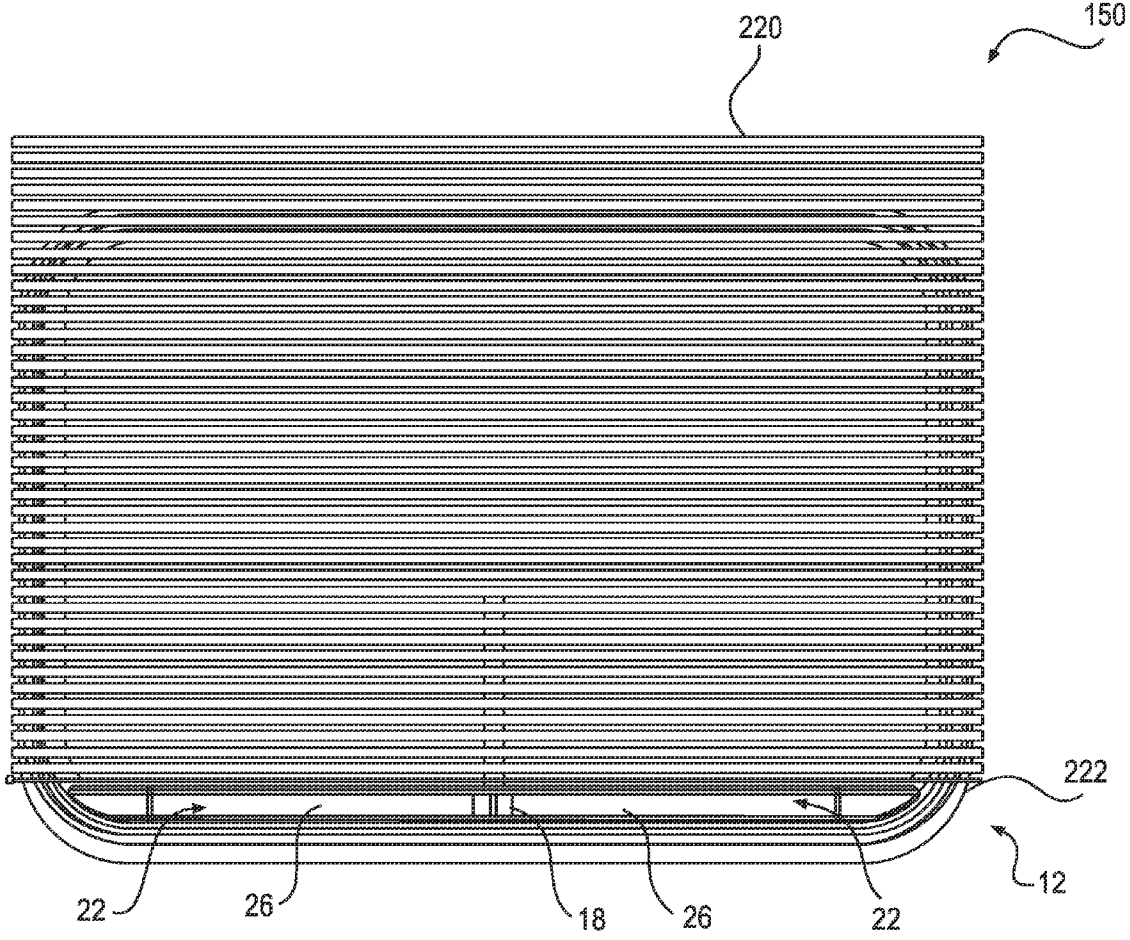
FIG. 44 is a front elevational view (i.e. interior view) of the combination of the motorized tilting window shown in FIG. 43 and window shade.

To operate the motorized tilting window 150 (FIG. 43), a user presses the left toggle switch 30 to open or close the left tilting window 22 and/or presses the right toggle switch 30 to open or close the right tilting window 22.

Other Embodiments

Figure 45:
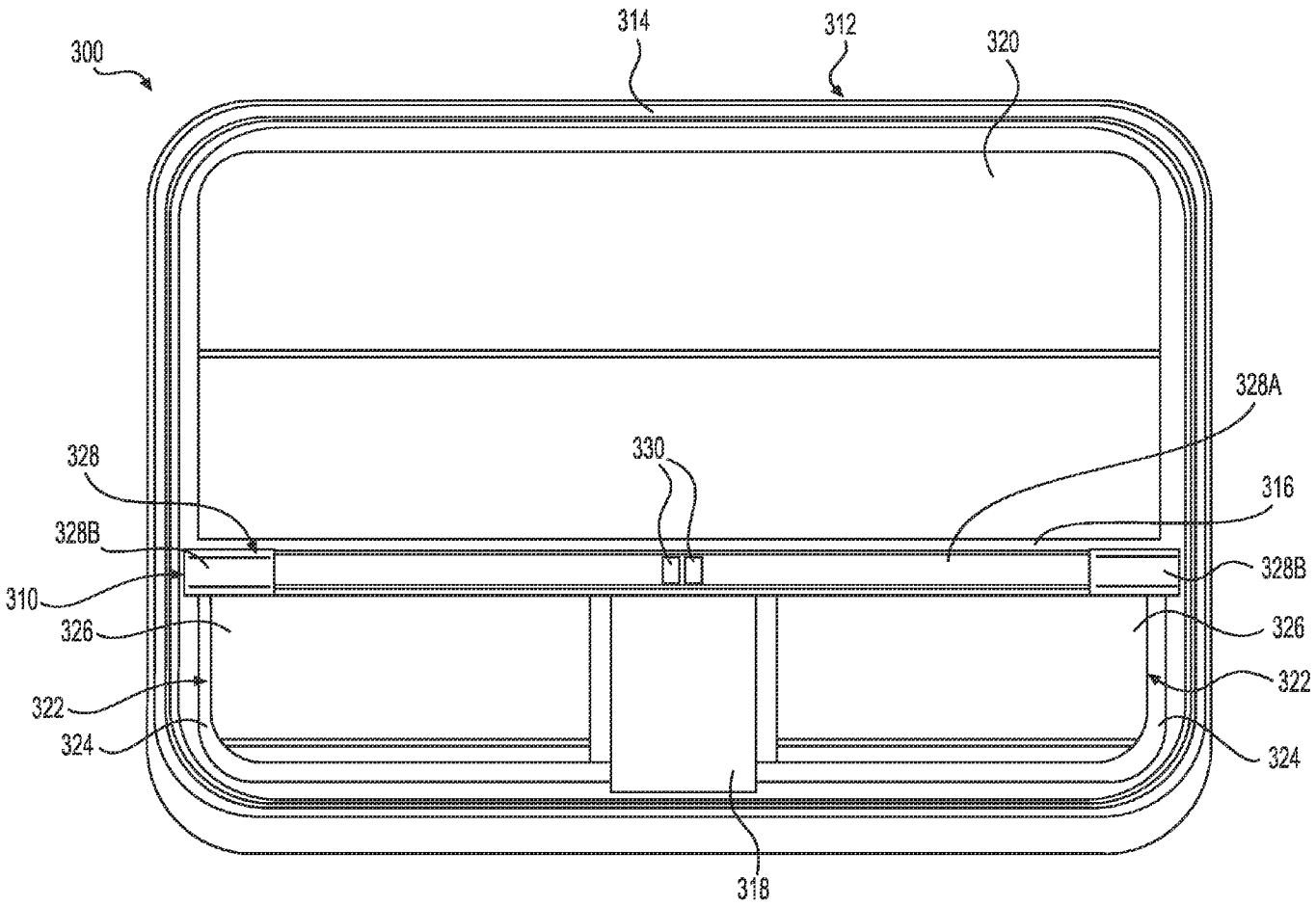
FIG. 45 is a front elevational view (i.e. interior view) of another motorized tilting window.

Another motorized tilting window 300 and another motorized tilting window operator 310 is shown in FIG. 45. The motorized tilting window operator 310 is shown fitted or installed onto a tilting window 312.

The tilting window 312 comprises a window frame 314. The window frame 314 comprises a horizontal window frame section 316 (i.e. horizontal cross-member) and a vertical window frame section 318 (i.e. vertical divider). The tilting window 312 comprises a window pane 320 (i.e. fixed window or tilting window) and two (2) tilting windows 322 each comprising a window sash 324 and a window pane 326.

The motorized tilting window operator 310 comprises a cover 328 provided with two (2) finger operated switches 330 (e.g. toggle switches) for independently operating each tilting window 322. The switches 330 fit into slots in the cover 328 (FIG. 46).

Figure 46:
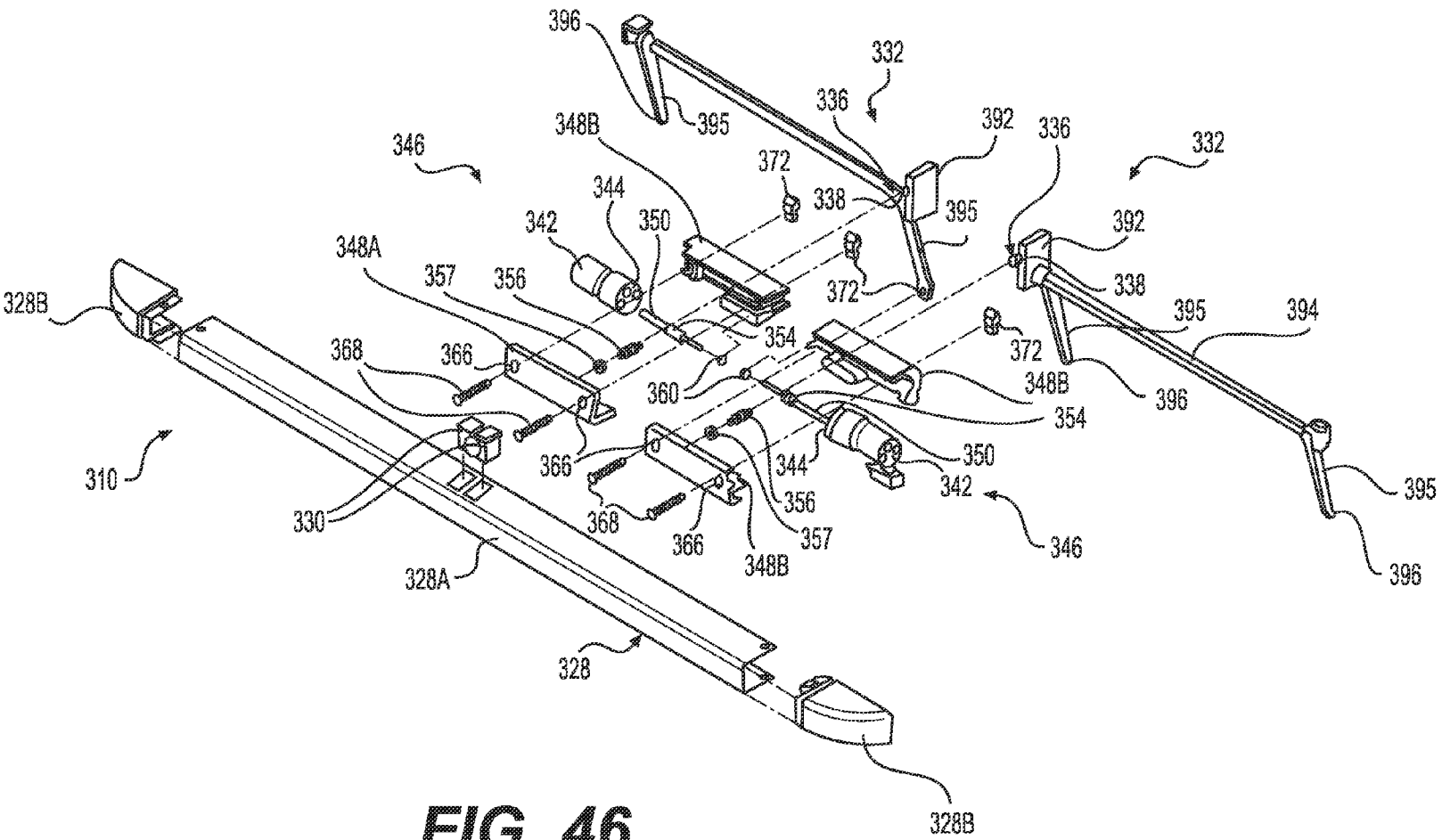
FIG. 46 is an exploded front perspective view of the motorized tilting window operator in combination with two (2) manual tilting window operators.
Figure 47:
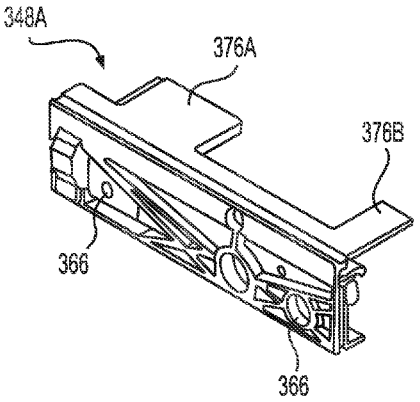
FIG. 47 is a perspective view of the right side top drive housing portion shown in FIG. 46.
Figure 48:
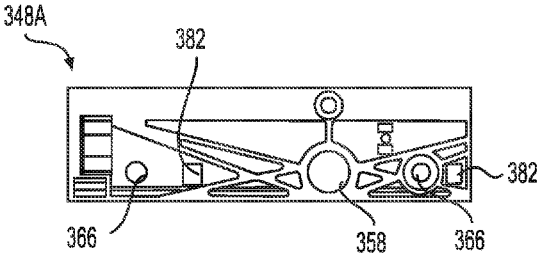
FIG. 48 is a front elevational view (i.e. exterior view) of the right side top drive housing portion shown in FIG. 47.
Figure 49:
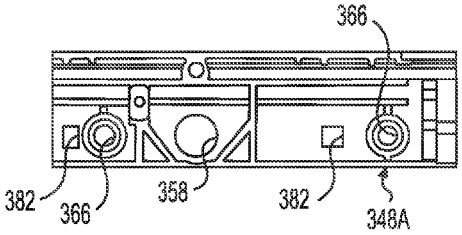
FIG. 49 is rear elevational view (i.e. interior view) of the right side top drive housing portion shown in FIG. 47.
Figure 50:
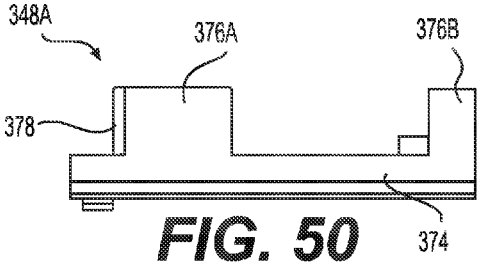
FIG. 50 is a top planar view of the right side top drive housing portion shown in FIG. 47.
Figure 51:
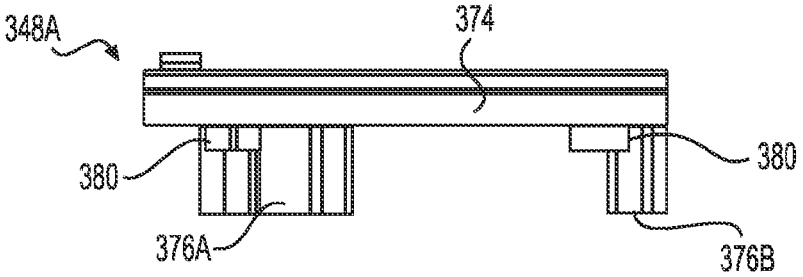
FIG. 51 is a bottom planar view of the right side top drive housing portion shown in FIG. 47.
Figure 52:
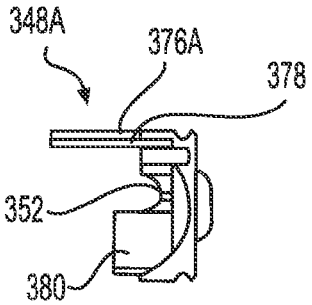
FIG. 52 is a left side elevational view of the right side top drive housing portion shown in FIG. 47.
Figure 53:
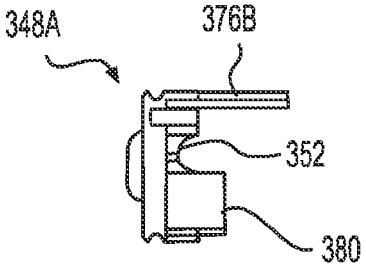
FIG. 53 is a right side elevational view of the right side top drive housing portion shown in FIG. 47.
Figure 54:
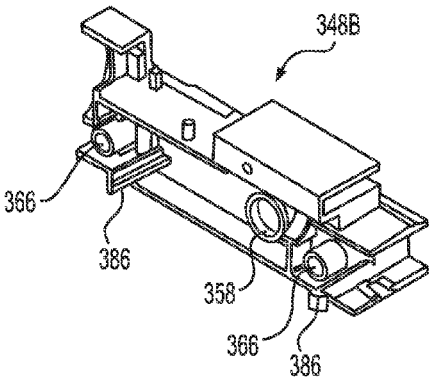
FIG. 54 is a perspective view of the right side bottom drive housing portion shown in FIG. 46.
Figure 55:
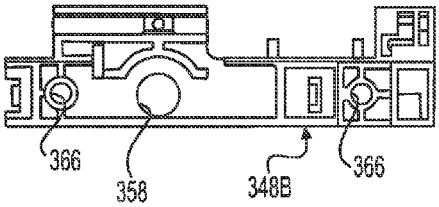
FIG. 55 is a front elevational view (i.e. exterior view) of the right side bottom drive housing portion shown in FIG. 54.
Figure 56:
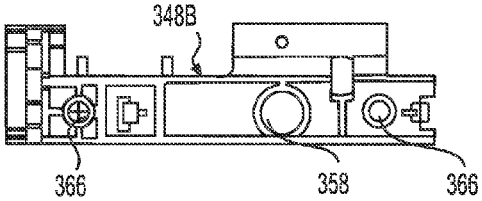
FIG. 56 is rear elevational view (i.e. interior view) of the right side bottom drive housing portion shown in FIG. 54.
Figure 57:
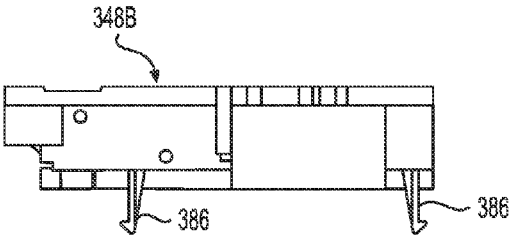
FIG. 57 is a top planar view of the right side bottom drive housing portion shown in FIG. 54.
Figure 58:
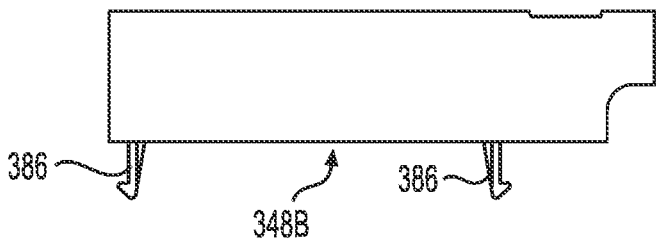
FIG. 58 is a bottom planar view of the right side bottom drive housing portion shown in FIG. 54.
Figure 59:
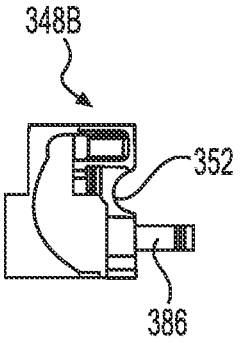
FIG. 59 is a left side elevational view of the right side bottom drive housing portion shown in FIG. 54.
Figure 60:
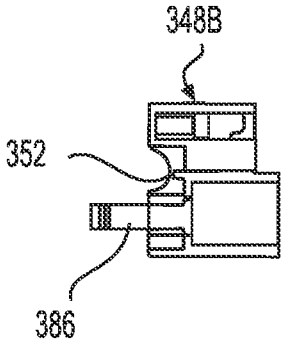
FIG. 60 is a right side elevational view of the right side bottom drive housing portion shown in FIG. 54.
Figure 61:
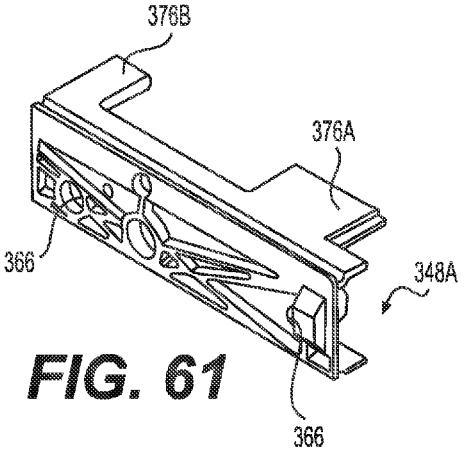
FIG. 61 is a perspective view of the left side top drive housing portion shown in FIG. 46.
Figure 62:
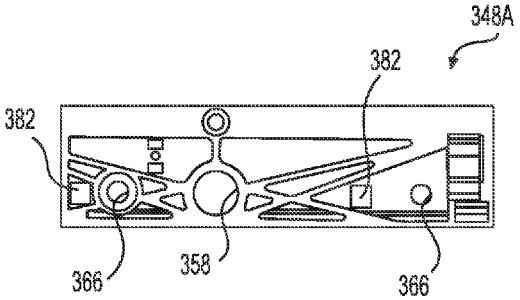
FIG. 62 is a front elevational view (i.e. exterior view) of the left side top drive housing portion shown in FIG. 61.
Figure 63:
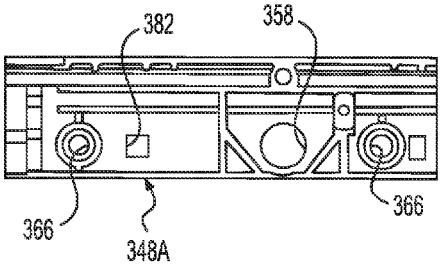
FIG. 63 is rear elevational view (i.e. interior view) of the left side top drive housing portion shown in FIG. 61.
Figure 64:
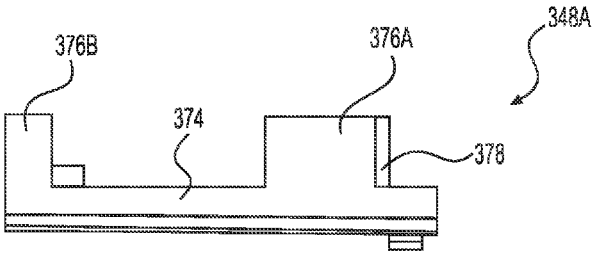
FIG. 64 is a top planar view of the left side top drive housing portion shown in FIG. 61.
Figure 65:
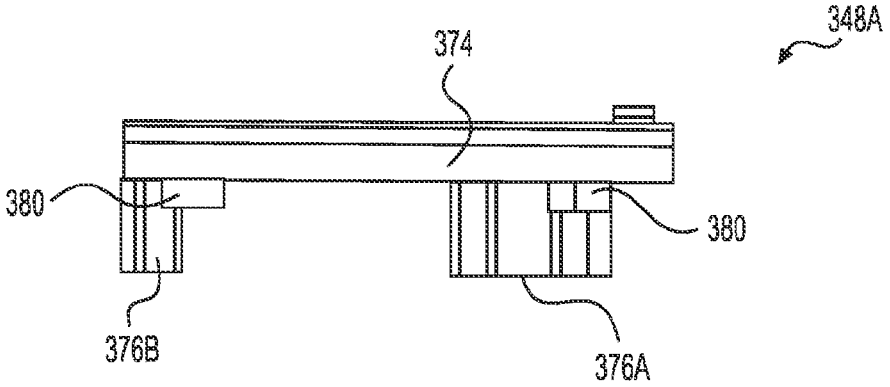
FIG. 65 is a bottom planar view of the left side top drive housing portion shown in FIG. 61.
Figure 66:
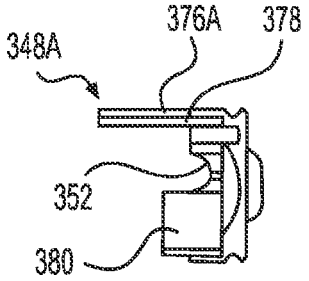
FIG. 66 is a left side elevational view of the left side top drive housing portion shown in FIG. 61.
Figure 67:
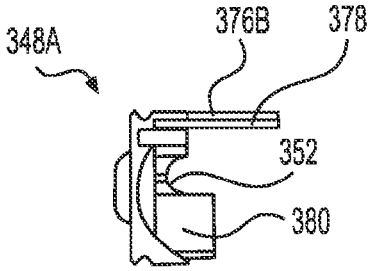
FIG. 67 is a right side elevational view of the left side top drive housing portion shown in FIG. 61.
Figure 68:
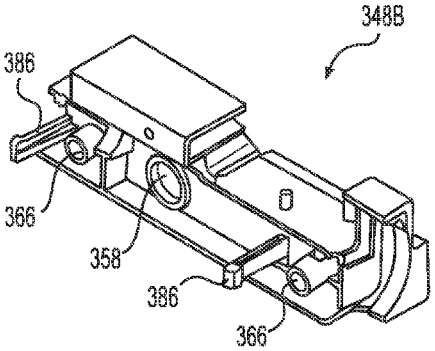
FIG. 68 is a perspective view of the left side bottom drive housing portion shown in FIG. 46.
Figure 69:
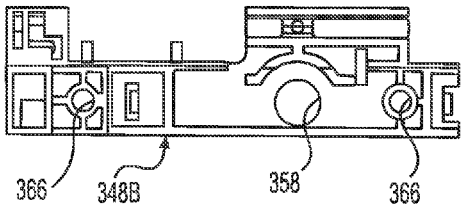
FIG. 69 is a front elevational view (i.e. exterior view) of the left side bottom drive housing portion shown in FIG. 68.
Figure 70:
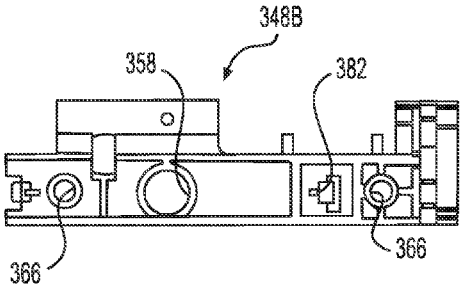
FIG. 70 is rear elevational view (i.e. interior view) of the left side bottom drive housing portion shown in FIG. 68.
Figure 71:
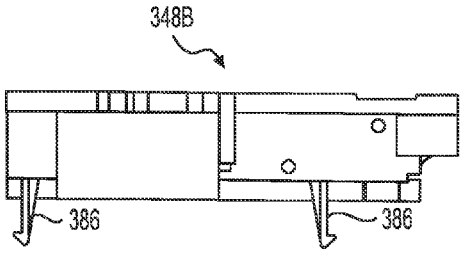
FIG. 71 is a top planar view of the left side bottom drive housing portion shown in FIG. 68.
Figure 72:
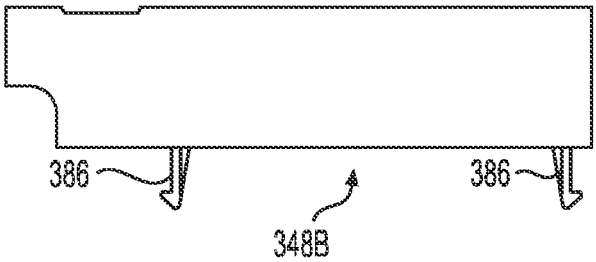
FIG. 72 is a bottom planar view of the left side bottom drive housing portion shown in FIG. 68.
Figure 73:
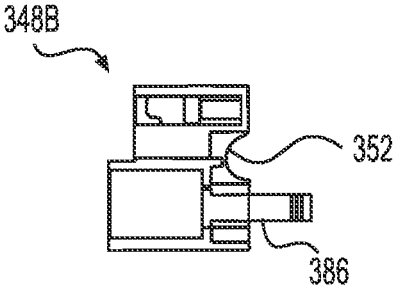
FIG. 73 is a left side elevational view of the left side bottom drive housing portion shown in FIG. 68.
Figure 74:
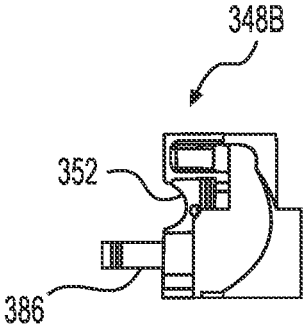
FIG. 74 is a right side elevational view of the right side bottom drive housing portion shown in FIG. 68.

The cover 328 comprises a center channel-shaped cover section 328A and two (2) end caps 328B, as shown in FIG. 46. The end caps 328B each comprise a flange provided with a set of upper and lower round-shaped protrusions configured to snap fit into a set of upper and lower through holes provided near each edge of the center channel-shaped cover section 328A to assemble the end caps 328B onto the center channel-shaped cover section 328A.

The motorized tilting window operator 310 connects to a pair of manual tilting window operators 332, as shown in FIG. 46. The manual tilting window operators 332 are connected to the window frame 314 of the tilting window 312 by screws. The manual tilting window operators 332 each include a drive shaft 336 fitted with a splined end 338. Specifically, the motorized tilting widow operator comprises two (2) motorized drive units 346, as shown in FIG. 46 disposed within the cover 328. The motorized drive units 346 each connect to a respective manual tilting window operators 332, when the motorized tilting window operator 310 is assembled onto the window frame 314 of the tilting window 312.

The motorized tilting window operator 310 can be a separate add on unit to a tilting window 312 already fitted with manual tilting window operators. Alternatively, the motorized tilting window operator 310 can be combined as a unit with the manual tilting window operators 332 to provide an add on unit to a tilting window 312, not yet fitted with any manual tilting window operators or with the existing manual tilting window operators removed to retro fit and upgrade the tilting window. As a further alternative, the motorized tilting window operator 310 connected to the manual tilting window operators 332 are installed together on a tilting window to provided an assembled tilting window unit ready for installation.

Motorized Drive Units

Other Embodiments

The motorized tilting window operator 310 comprises two (2) drive units 346, as shown in FIG. 46. The construction or arrangement of each drive unit 346 is shown in detail in FIG. 47 thru 77.

The drive units 346 each connect to an electric motor 342 fitted with a motor mount plate 344 configured to connect to a respective drive unit 346.

The drive unit 346 includes a drive unit housing 348, including a top drive unit housing 348A shown in detail in FIGS. 47-53 and FIGS. 61-67, and a bottom drive unit housing 348B shown in detail in FIGS. 54-60 and FIGS. 68-74.

Figure 75:
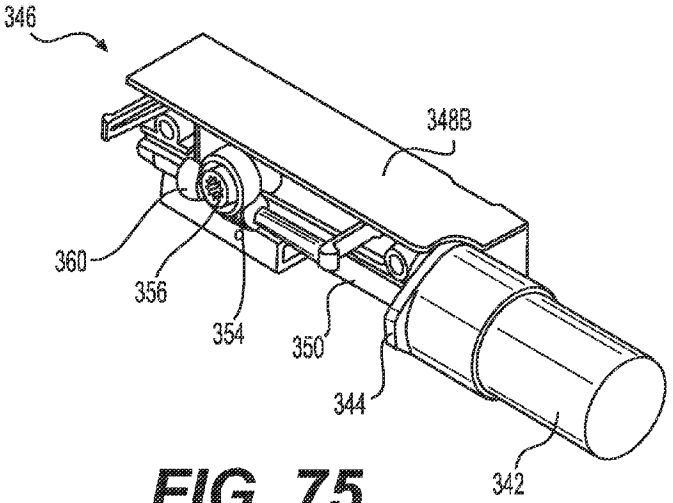
FIG. 75 is a perspective view of one of the motorized drive units of the motorized tilting window operator shown in FIG. 46 with the top drive housing portion removed.
Figure 76:
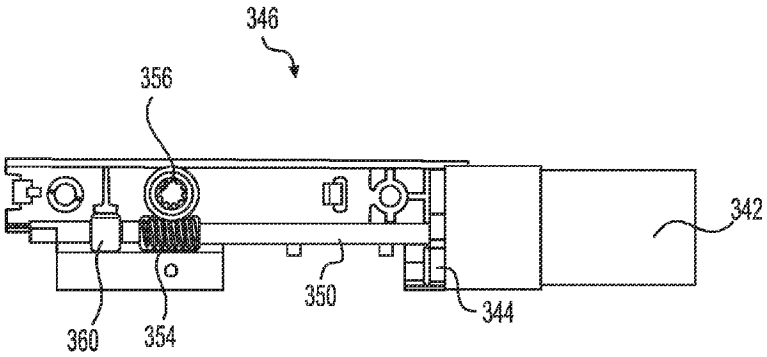
FIG. 76 is a front elevational view of the motorized drive unit shown in FIG. 75.
Figure 77:
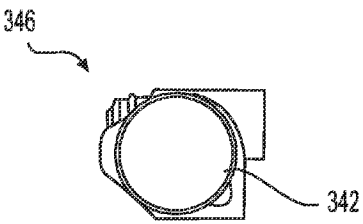
FIG. 77 is a left side elevational view of the motorized drive unit shown in FIG. 75.
Figure 78:
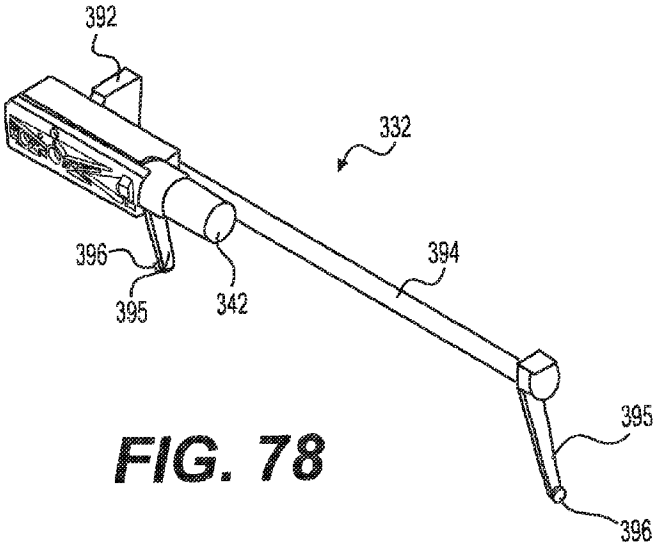
FIG. 78 is a perspective view of one of the manual operators of the motorized tilting window operator shown in FIG. 46.
Figure 79:
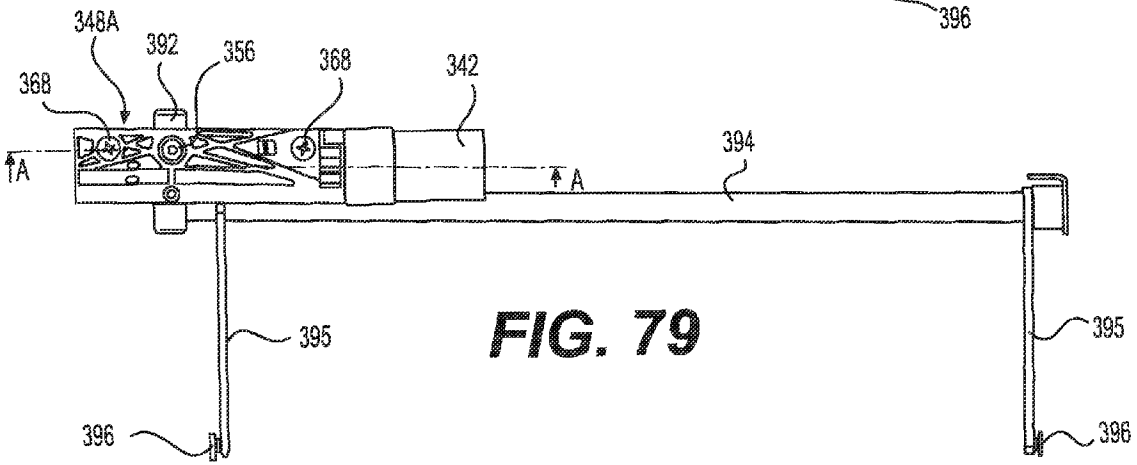
FIG. 79 is a front elevational view of the manual operator shown in FIG. 78.

As shown in FIGS. 75-77, each drive unit 346 comprises a drive shaft 350 rotatably disposed within the drive unit housing 348 in recesses 352. The drive shaft 350 is provided with a worm 354 cooperating with a worm gear 356. The worm gear 356 and worm gear bushing 357 are disposed within a close fitting through hole 358 to provide a rotational axis of the worm gear 356.

The drive shaft 350 is fitted with a set of flanged bearings 360 spaced apart on the drive shaft 350. The flanged bearings 360 are received within the recesses 352 in the drive unit housing 348.

The drive shaft 350 is oriented along a longitudinal axis of the drive unit housing 348, and located on center, or off center relative to a height dimension of the drive unit housing 348. The worm gear 356 received within the close fitting through hole 358 is oriented along a width axis (e.g. center, or off center) of the drive unit housing 48. Thus, the axis of rotation of the worm gear 356 is perpendicular relative to the axis of rotation of the drive shaft 350 and worm 354.

The motor mount plate 344 is assembled to the electric motor 342 by screw fasteners 343. The motor mount plate 344 is received within a close fitting recess 364 provided on an end of each drive unit housing 348. The motor mount plate 344 is shaped so as to key and lock within the close fitting recess 364 to prevent rotation between the electric motor 342 and drive unit 346 when the motorized drive unit 340 is operated. Further, the motor mounting plate 344 is fitted with a flange bearing 345 for rotatably supporting the drive shaft 350 within the motor mounting plate 344.

The drive shaft 350 can be the motor shaft of the electric motor 342 (i.e. one piece construction). Alternatively, the electric motor 342 can be a separate motor shaft connecting to the drive shaft 350 of the drive unit 346, for example, when assembling the electric motor 342 and drive unit 346 together with a coupling arrangement. As an example, the motor shaft is specially shaped (e.g. provided with a keyway, flat segment, or splined) to couple to the end of the drive shaft 350.

The configuration of the close fitting recesses 352 receiving the bearings 360 provided on drive shaft 350 maintains the drive shaft 350 and worm 354 in rotational alignment and prevents deflection during operation. Further, the close fitting through hole 358 receiving the worm gear 56 maintains the worm gear 356 in rotation alignment during operation. This arrangement maintains the worm 354 and worm gear 356 in alignment and engagement during operation. Specifically, the close fitting recesses 352 capturing bearings 360 prevent deflection of the drive shaft 350 by firmly supporting the drive shaft 350 at positions in proximity and located on opposite sides of the worm 354. The close fitting through hole 358 prevents misalignment of the worm gear 356 by closely confining the outer surfaces (dimensions) of the rotating worm gear 356 during operation. Thus, the assembled drive unit housing 348 configuration provides the necessary structural strength and configuration to provide and maintain the operational integrity, coupling, and alignment of the all drive train components, including the electric motor 342, drive shaft 350, worm 354, and worm gear 356 after assembly of each motorized drive unit 340 during operation.

Drive Unit Housing

Other Embodiments

Detailed views of the drive unit housings 348A, 348B are shown in FIG. 47 thru 74.

The top drive unit housing 348A is provided with the close fitting through hole 358 for accommodating the worm gear bearing 357 on the interior side of the top drive unit housing 348A. The through hole 358 also provides access to the worm gear 356 for insert a tool into the splined through hole 390 in the worm gear 356 to manually operate the drive unit 346 in the event of a power shortage (e.g. cover 328 is first removed, and then a tool comprising a splined end is inserted into the through hole 58 located in the top drive unit housing 348A, and then into the splined through hole 390 of the worm gear 356). Further, the top drive unit housing 348A is provided with through holes 366 for accommodating bolt fasteners 368 for connecting the motorized drive units 340 to the window frame 314. Specifically, the bolt fasters 368 having outer threaded ends fitting into and through the through holes 366 in the top drive unit housing 348A, the through holes 366 in the bottom drive unit housing 348B, and the through holes 370 of the window frame 314 fitted with blind fasteners 372 having inner threaded holes.

The top drive unit housing 348A is provided with connector portions 376 having flanges 378, connector tabs 380, and square-shaped connector slots 382 for connecting the top drive unit housing 348A to the bottom drive unit housing 348B by a snap fit connection to be described in detail below.

The top drive unit housing 348A is provided with the close fitting recesses 352 for accommodating the bearings 360 of the drive shaft 350.

The bottom drive unit housing 348B is provided with the close fitting through hole 358 for accommodating the worm gear 356 on the interior side of the bottom drive unit housing 348B. Further, the bottom drive unit housing 348B is provided with through holes 366 for accommodating bolt fasteners 368 for connecting the motorized drive units 340 onto the window frame 314. The through holes 366 in the bottom drive unit housing 348B align with the through holes 366 in the top drive unit housing 348A.

The bottom drive unit housing 348B is provided with connector slots 384 for receiving the connector portions 376 of the top drive unit housing 348A. In addition, the bottom drive unit housing 348A is provided with connector prongs 386 configured to snap fit into the square-shaped connector slots 382 of the top drive unit housing 348A.

The bottom drive unit housing 348B is provided with the close fitting recesses 352 for accommodating the bearings 360 of the drive shaft 350.

Worm Gear Drive

Other Embodiments

The motorized drive units 340 each comprise a worm gear drive 388 comprising the drive shaft 350 fitted with the worm 354 cooperating with the worm gear 356.

The rotational axis of the drive shaft 350 and worm 354 is perpendicular relative to the axis of rotation of the worm gear 356. Further, the drive shaft 350 is rotatably supported by the set of bearings 360, and worm gear 356 is rotatably supported by the close fitting through hole 356 to maintain the alignment and full engagement of the worm 354 and worm gear 356 of the worm gear drive 388 during operation of the motorized drive unit 340.

The worm gear 356 is provided with a splined socket 390 (i.e. output) to connect with the splined end 338 of the respective drive shafts 336 (i.e. input) of the each manual tilting window operator 332. Specifically, each motorized drive unit 340 is installed on top of each manual tilting window operator 332 with the splined socket 360 of the worm gear 356 interconnecting with the splined end 338 of the respective manual tilting window operator 332 to provide an operational connection between each motorized drive units 340 and each manual tilting window operator 332.

Cover

Other Embodiments

The top drive unit housing 348A is provided with upper and lower longitudinal grooves 374 (FIGS. 50 and 51) for connecting with bend ends 328A of the cover 328 (e.g. to provide a snap fit connection) to the drive unit housings 348 of the motorized drive units 340. This removable cover arrangement will be described in more detail below.

Electrical System

Other Embodiments

The motorized tilting window operator 310 can be wired to the power supply or system of the vehicle or structure for operating the electrical motor 342. The electrical motor 342 can be wired and controlled by one of the switches 330. Alternatively, the motorized tilting window operator 310 can be powered independently. Further, a backup battery pack can be added to allow motorized operation during a power outage.

The electric motors 342 are configured to operate in both directions by control of the switches 330 (e.g. switches 330 configured to toggle from a neutral unpowered position to two (2) operational positions, including a forward or a reverse position to open and close the tilting windows 322).

Assembly

Other Embodiments

The drive unit housings 348A, 348B are configured and designed to facilitate quick assembly of each drive unit 346 without any tools required for assembly (e.g. the drive unit housings 348A, 348B are configured to snap fit together). Specifically, with the bottom drive unit housing 348B separated from the top drive unit housing 348A, the worm gear 356 and bushing 357 are installed into the through hole 358 provided in the bottom drive unit housing 348B. Then, the drive shaft 350 is installed into the bottom drive unit housing 348 B. Specifically, the bearings 360 of the drive shaft 350 are inserted into the recesses 360 while inserting the motor mounting plate 344 of the electric motor 342 into the recess 364.

The top drive unit housing 348A is then snap fit onto the bottom drive unit housing 348B to complete the assembly.

The motorized drive units 340 are then installed onto both the manual tilting window actuators 332 and window frame by fitting the splined sockets 390 of the worm gears 390 of the motorized drive units 340 over the splined ends 338 of the drive shafts 336 of the manual tilting window operators 332. When the motorized drive units 340 are fully seated over the manual tilting window operators, the motorized drive units 340 are attached to the window frame 314 using bolt fasteners 368. Specifically, the bolt fasteners are inserted into and through the through holes 370 provided in the drive unit housings 348A, 348B, and then inserted into through holes 370 provided in the window frame 314. The through holes 370 provided in the window frame 314 are fitted with blind fasteners 372, which have threaded holes for receiving the thread ends of the bolt fasteners 372 for securing the motorized drive units 340 onto the window frame 314.

Combined Motorized Tilting Window Operator

Other Embodiments

The combined motorized/manual tilting window operator 310 is shown in FIG. 46. The combined motorized tilting window operator 310 comprises the motorized tilting window operator 310 (FIG. 12) connected together with one or more manual tilting window operators 332. Specifically, the motorized tilting window operator 310 and manual tilting window operators 332 can be assembled together as a unit to create the combined motorized/manual tilting window operator 310. This combination can be applied to a new tilting window having no operator device or arrangement yet installed, or to an existing tilting window with the existing tilting window operator removed in advance for installation of the new combined motorized/manual tilting window operator.

Alternative Features

Other Embodiments

Figure 80:
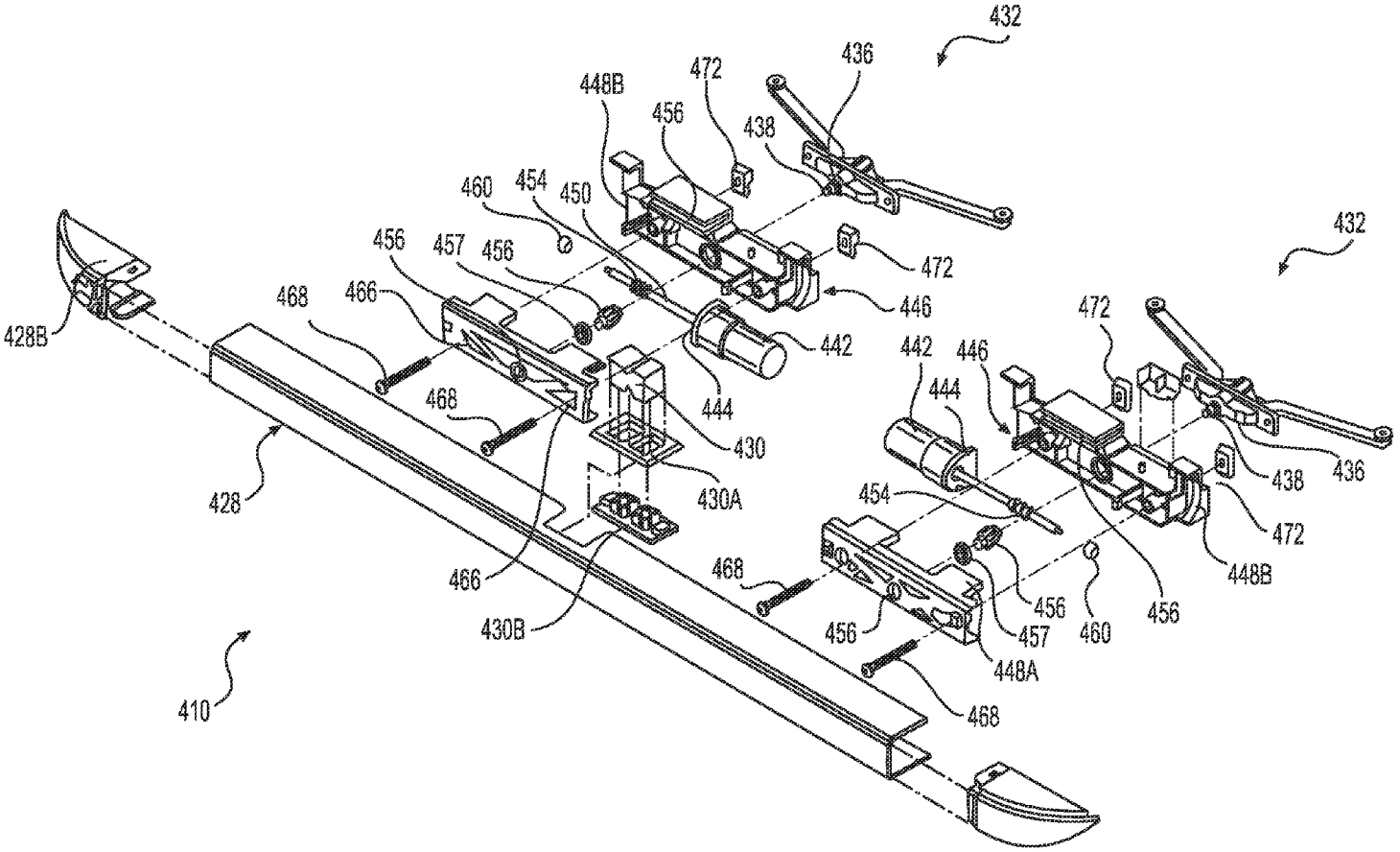
FIG. 80 is a perspective view of an alternative embodiment of the motorized tilting window operator with manual operators shown in FIG. 31.

Another combined motorized/manual tilting window operator 410 is shown in FIG. 80.

The combined motorized/manual tilting window operator 410 comprises a pair of switches 430 (e.g. toggle switches) positioned on the upper side of the cover 428 instead of being located on a front side of the cover 28 (FIG. 31). This alternative switch location can be selected in some applications.

Further, the switches 430 are installed through a mounting plate 430A located on the upper side of the cover 428. The switches 430 are mounted on a circuit board 430B reducing the amount of wiring for connecting and controlling the electrical motors 442 of the combined motorized/manual tilting window operator 410.

Figure 81:
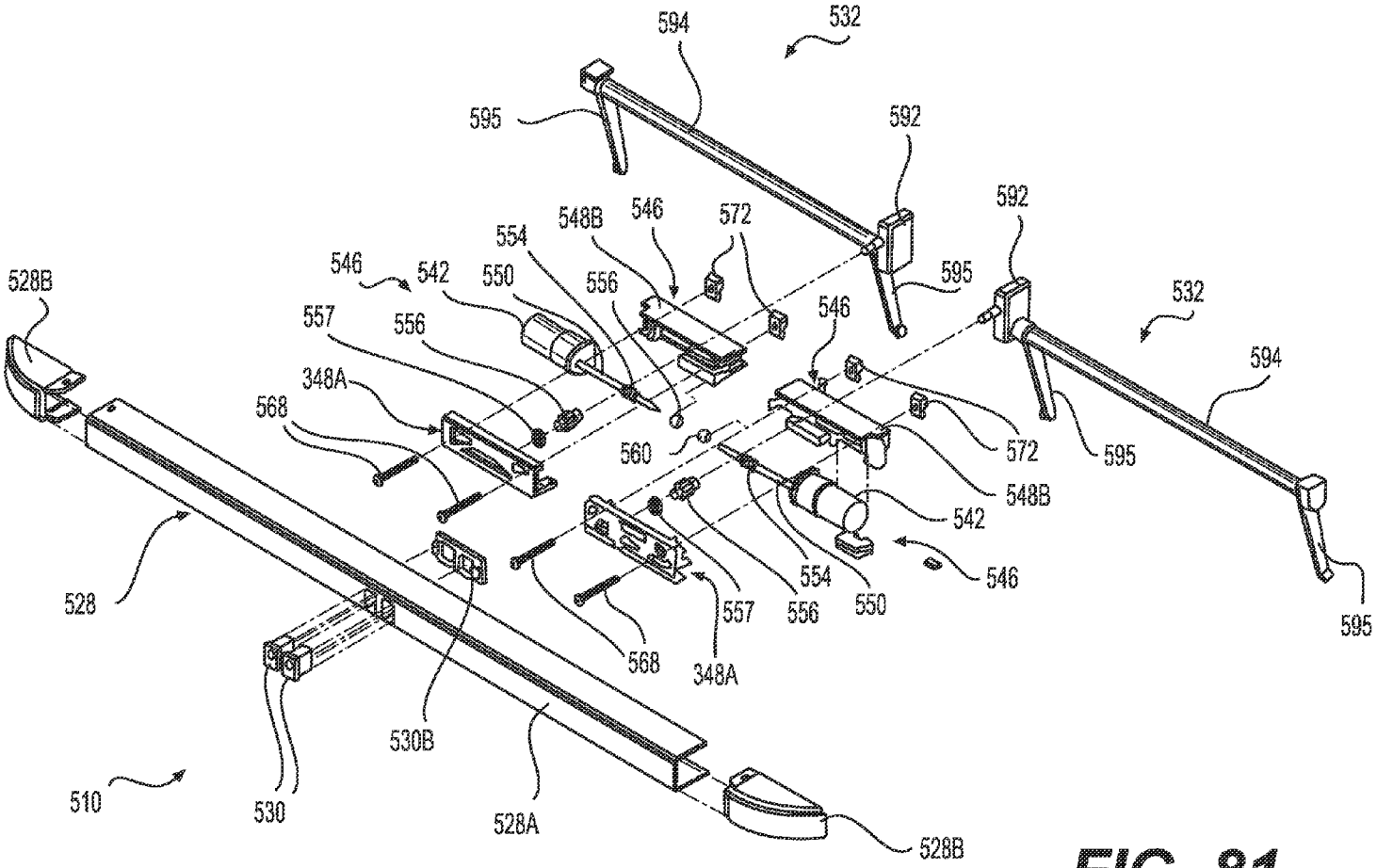
FIG. 81 is a perspective view of an alternative embodiment of the motorized tilting window operator with manual operators shown in FIG. 46.

A further combined motorized/manual tilting window operator 510 is shown in FIG. 81.

The combined motorized/manual tilting window operator 510 comprises a pair of switches 530 (e.g. toggle switches) positioned on the front side of the cover 528 instead of being located on the upper side of the cover 328 (FIG. 46). This alternative switch location can be selected in some applications.

Further, the switches 530 extend through holes in the upper side of the cover 528, and are mounted on a circuit board 530B reducing the amount of wiring for connecting and controlling the electrical motors 542 of the combined motorized/manual tilting window operator 510.

The invention claimed is:

1. A motorized tilting window operator for installation on a tilting window having multiple tilting window sashes and multiple corresponding manual tilting window operators, the manual window operators spaced apart from each other and installed on a window frame of the tilting window, the motorized tilting window operator comprising:

a first motorized drive unit connectable to one of the manual tilting window operators, the first motorized drive unit comprising a first housing having upper and lower longitudinal grooves;

a second motorized drive unit connectable to another one of the manual tilting window operators, the second motorized drive unit comprising a second housing having upper and lower longitudinal grooves;

an electronic control connected to and controlling the motorized drive units to open or close the titling window sashes of the tilting window; and a channel-shaped cover configured to removably connect to and cover the motorized drive units of the tilting window, the cover including upper and lower protrusions configured to snap fit into the upper and lower grooves of the first housing and the second housing to removably connect the cover to the drive units, wherein each of the motorized drive units comprises an electric motor, a drive shaft, a worm and a worm gear, wherein for each of the drive units, the drive shaft is fitted with the worm which cooperates with the worm gear, each of the drive shafts and the worm gears being received within a respective one of the housings, and wherein each of the worm gears is provided with a splined through hole for receiving a splined end of a drive shaft of the respective manual tilting window operator.

2. The operator according to claim 1, wherein the electronic control comprises control switches connected to the cover.

3. The operator according to claim 1, wherein the motorized drive units are connected to the respective manual tilting window operators.

4. The operator according to claim 3, wherein the motorized drive units are also connected to the window frame of the tilting window.

5. The operator according to claim 1, wherein each of the drive unit housings comprises a top drive unit housing portion and a bottom drive unit housing portion.

6. The operator according to claim 5, wherein the top drive unit housing portion and the bottom drive unit housing portion of each of the drive unit housings are configured to releasably connect together.

7. The operator according to claim 6, wherein for each of the drive unit housings, one of the drive unit housing portions comprises a connector prong and the other one of the drive unit housing portions comprises a connector slot for receiving the connector prong.

8. The operator according to claim 6, wherein for each of the drive units, the drive shaft is fitted with a pair of bearings configured to be received within a set of recesses in the drive unit housing to prevent deflection of the drive shaft during operation of the drive unit.

9. The operator according to claim 8, wherein for each of the drive units, the worm gear is disposed within a through hole in the drive unit housing to prevent misalignment of the worm gear during operation of the drive unit.

10. The operator according to claim 1, wherein the housing of each of the drive units comprises an access hole for providing access for a hand tool to engage the splined through hole of the worm gear and manually rotate the worm gear to operate the drive unit.

11. The operator according to claim 10, further comprising the hand tool.

12. The operator according to claim 11, wherein the hand tool is accessible by removal of an end cap of the cover.

13. The operator according to claim 11, wherein the hand tool is stored within the cover.

14. The operator according to claim 1, including a battery pack configured to operate the motorized tilting window operator.

15. The operator according to claim 14, wherein the battery pack is disposed within the cover.

16. The operator according to claim 15, wherein the battery pack is accessible by removal of an end cap of the cover.

17. The operator according to claim 1, further comprising a remote control unit configured to operate the drive units remotely.

18. The operator according to claim 1, further comprising a detector for detecting rain or wind, the detector connected to the electronic control for automatically closing the tilting window.

19. The operator according to claim 1, further comprising a window shade comprising a lower member configured to contact with an upper surface of the cover.

20. A motorized tilting window operator for installation on a tilting window fitted with multiple manual tilting window operators spaced apart relative to each other and installed on a window frame of the tilting window, comprising:

multiple motorized drive units spaced apart relative to each other, each motorized drive unit comprising:

an electric motor;

a drive unit connected to the electric motor, the drive unit comprising:

a drive unit housing comprising a first drive unit housing and a second drive unit housing configured to releasably connect together, the drive unit housing having upper and lower longitudinal grooves;

a drive shaft rotatably disposed within the drive unit housing along a longitudinal axis of the drive unit housing;

a set of bearings provided on the drive shaft, each of said bearings being received within a corresponding recess provided within the drive unit housing;

a worm installed on the drive shaft;

a worm gear rotatably disposed within a through hole provided in the drive unit housing and in operational engagement with the worm, a rotational axis of the worm gear being oriented perpendicular relative to a rotational axis of the drive shaft and worm, the worm gear comprising a splined through hole for receiving a splined end of one of the manual tilting window operators, the splined through hole in the worm gear also being accessible through an access hole in the drive unit housing so that a hand tool can access and engage the splined through hole of the worm gear and rotate the worm gear to operate the one of the manual tilting window operators, the through hole of the drive unit housing confines and rotatably guides the worm gear and maintains the worm gear in the operational engagement with the worm;

an electronic control connected to and controlling the motorized drive units to open or close the titling window; and a channel-shaped cover configured to removably connect to the drive unit housings and cover the drive units of the tilting window, the cover including upper and lower protrusions configured to snap fit into the upper and lower grooves of the drive unit housings to removably connect the cover to the drive units.

21. The operator according to claim 20, further comprising a window shade comprising a lower member configured to contact with an upper surface of the cover.

22. A motorized tilting window operator for installation on a tilting window having multiple tilting window sashes and multiple corresponding manual tilting window operators, the manual window operators spaced apart relative to each other and installed on a window frame of the tilting window, the motorized tilting window operator comprising:

a first motorized drive unit connectable to one of the manual tilting window operators, the first motorized drive unit comprising a first housing having an upper longitudinal groove provided in an upper side surface of the first housing and a lower longitudinal groove provided in a lower side surface of the first housing;

a second motorized drive unit connectable to another one of the manual tilting window operators, the second motorized drive unit comprising a second housing having an upper longitudinal groove provided in an upper side surface of the second housing and a lower longitudinal groove provided in a lower side surface of the second housing;

an electronic control connected to and controlling the motorized drive units to open or close the tilting window sashes of the tilting window; and a channel-shaped cover configured to removably connect to and cover the motorized drive units of the tilting window, the cover including an upper inner surface having an downwardly extending protrusion and a lower inner surface having an upwardly extending protrusion, the protrusions of the cover being configured to snap fit into the upper and lower grooves of the first housing and the second housing to removably connect the cover to the drive units, the cover, the first housing, and the second housing being configured so that the upper side surface of each of the first housing and the second housing are located adjacent to the upper inner surface of the cover and the lower side surface of each of the first housing and the second housing are located adjacent to the lower inner surface of the cover when the cover is installed on the drive units, wherein each of the motorized drive units comprises an electric motor, a drive shaft, a worm and a worm gear, wherein for each of the drive units, the drive shaft is fitted with the worm which cooperates with the worm gear, each of the drive shafts and the worm gears being received within a respective one of the housings, and wherein each of the worm gears is provided with a splined through hole for receiving a splined end of a drive shaft of the respective manual tilting window operator.

23. The operator according to claim 22, wherein the protrusions are rounded convex-shaped protrusions and the grooves are corresponding rounded concave-shaped grooves.

24. The operator according to claim 23, wherein the protrusions are oriented and extend along a length of the cover.

25. The operator according to claim 24, wherein for each of the housings, the grooves are oriented and extend along a length of the housing.

26. The operator according to claim 25, wherein the grooves of the housings are located adjacent to a front side of a respective one of the housings and the protrusions of the cover are located adjacent to a closed front end of the cover.

27. The operator according to claim 22, further comprising a window shade comprising a lower member configured to contact with an upper outer surface of the cover.

* * * * *